US007959380B2

(12) United States Patent
McIntosh

(10) Patent No.: US 7,959,380 B2
(45) Date of Patent: Jun. 14, 2011

(54) LANDSCAPING SYSTEM

(75) Inventor: Robert Gordon McIntosh, Abbotsford (CA)

(73) Assignee: Pacific Fence-Crete Ltd., Aldergrove, B.C. (CA)

( * ) Notice: Subject to any disclaimer, the term of this patent is extended or adjusted under 35 U.S.C. 154(b) by 205 days.

(21) Appl. No.: 12/060,125

(22) Filed: Mar. 31, 2008

(65) Prior Publication Data

US 2009/0094917 A1 Apr. 16, 2009

Related U.S. Application Data

(63) Continuation-in-part of application No. 29/290,012, filed on Oct. 11, 2007, now Pat. No. Des. 587,381, and a continuation-in-part of application No. 29/290,013, filed on Oct. 11, 2007, now Pat. No. Des. 579,122.

(51) Int. Cl.
*E02D 29/02* (2006.01)
*E04C 1/00* (2006.01)

(52) U.S. Cl. ..... 405/286; 405/284; 52/604; 264/333

(58) Field of Classification Search ..... 405/262, 405/284, 286; 52/603, 604, 608, 609, 610, 52/612; D25/113; 264/333
See application file for complete search history.

(56) References Cited

U.S. PATENT DOCUMENTS 338,490 A * 3/1886 Cowan ..... 52/609
1,751,272 A * 3/1930 Forman ..... 52/603
2,198,011 A * 4/1940 Muirhead ..... 52/609
D213,618 S 3/1969 Pickering
4,068,482 A * 1/1978 Hilfiker ..... 405/272
D249,976 S 10/1978 Gronert
D250,898 S 1/1979 Schuring
D252,951 S 9/1979 Schuring
D283,551 S 4/1986 Repasky
D299,068 S 12/1988 McSorley et al.
D299,069 S 12/1988 Risi et al.
5,120,164 A * 6/1992 Iacocca et al. ..... 405/284
D331,469 S 12/1992 McMarlin
D340,293 S 10/1993 Risi et al.
5,337,527 A 8/1994 Wagenaar
D352,560 S 11/1994 Lin
D365,643 S * 12/1995 Wilhelm ..... D25/113
5,607,262 A * 3/1997 Martin ..... 405/286
D386,265 S 11/1997 Ellington
D424,714 S 5/2000 Hale
6,318,934 B1 * 11/2001 Borgersen et al. ..... 405/262
(Continued)

OTHER PUBLICATIONS

CreteFoamer, Cellular Concrete Solves Problems, World of Concrete 2008, Richway Industries, Ltd., brochure, 4 pages.

(Continued)

*Primary Examiner* — Frederick L Lagman
(74) *Attorney, Agent, or Firm* — Knobbe, Martens, Olson & Bear, LLP

(57) ABSTRACT

A construction apparatus including a body having a front, a rear, a top, a bottom, and first and second opposite sides. The front has a front surface having a plurality of block images configured to generally depict a plurality of courses of blocks, each of the courses having a respective course width. The first and second sides have generally complementary step shapes including at least two rises and at least one run between the rises, each rise being about equal to one of the course widths or a sum of a plurality of the course widths.

45 Claims, 37 Drawing Sheets

U.S. PATENT DOCUMENTS

| | | | | |
|---|---|---|---|---|
| D484,620 | S | 12/2003 | He | |
| 6,679,656 | B1 * | 1/2004 | Manthei | 405/284 |
| D511,579 | S | 11/2005 | Risi et al. | |
| D516,228 | S | 2/2006 | Dunbar | |
| D541,951 | S | 5/2007 | Mugge et al. | |
| 7,244,079 | B1 * | 7/2007 | Blomquist et al. | 405/284 |
| D579,122 | S | 10/2008 | McIntosh | |
| D587,381 | S | 2/2009 | McIntosh | |
| D600,359 | S * | 9/2009 | King | D25/113 |

OTHER PUBLICATIONS

Rocky Mountain Stoneworks Ltd., brochure, 8 pages.

Field Construction Manual, United Lock-Block Ltd., downloaded from website www.unitedlockblock.com/docs/gravity.doc, Apr. 3, 2008, 6 pages.

Rocky Wall Retaining Walls, brochure, no. date, 2 pages.

Photograph of Handler New 3MPH from Coote Concrete Production Machinery, downloaded from website http://web.archive.org/web/20010412144152/cooteus.com/handler/handle..., Jun. 12, 2009, 1 page.

"Adhesive Retaining Wall and Paver," product brochure, SRW Products, 2 pages.

"Installation Guide, Retaining Walls up to 6 Feet in Height, SRW Universal Geogrid" product brochure, SRW Products, 2 pages.

Bradstone the Natural Stone Alternative—Mountain Block Retaining Wall, downloaded from website http:///bradstone.ca/index/php?option=com_content&tast=view&id=..., Aug. 14, 2007, 2 pages.

* cited by examiner

LANDSCAPING SYSTEM

RELATED APPLICATIONS

The present non-provisional utility patent application is a continuation-in-part of U.S. Design application No. 29/290,012 and U.S. Design application No. 29/290,013, both filed Oct. 11, 2007. The complete disclosures of these prior applications are incorporated herein in their entirety by this reference thereto.

BACKGROUND OF THE INVENTION

1. Field of Invention

The invention relates generally to landscaping, and more particularly to systems and apparatuses for constructing a landscaping system such as a retaining wall.

2. Description of Related Art

One known method of constructing a retaining wall involves positioning individual decorative units such as blocks, bricks, tiles, or rocks, and using a plastic curable material such as mortar to bind the individual units together. This method advantageously produces a retaining wall having a plurality of decorative units. However, the time and labour to build the retaining wall can be costly.

Other known methods of retaining wall construction involve the use of blocks made from concrete, for example. Conventional wall construction blocks are typically stackable and may interlock with adjacent wall blocks to form a retaining wall. These wall construction blocks are typically relatively inexpensive and straightforward to assemble, although disadvantageously these conventional blocks often form an unattractive wall that looks conspicuously formed of standard wall construction blocks because the joints between the blocks may be highly noticeable, and because the front faces of the blocks typically resemble concrete.

Where wall construction blocks are used to form a retaining wall to retain soil or other material, the blocks are typically stacked with a setback such that blocks in a given row have a centre of mass that is behind the centre of mass of blocks in a row below. This setback may enhance the stability of the retaining wall by better accommodating the natural forward-urging force of material behind the retaining wall. One conventional method of achieving this setback is to use wall blocks that have alignment means on the top and bottom of the blocks for causing a block to be aligned rearward of a block below it. However, this method can undesirably produce a wall having conspicuous setback gaps between adjacent upper and lower blocks. Another known method for producing this setback is to produce a non-level base surface, inclined downward to the rear, on which to assemble the blocks. Placing blocks on this inclined surface produces a wall that is also rearwardly inclined. However, this method is also undesirable because producing a rearwardly inclined base surface for building a wall can be complicated and time consuming.

SUMMARY OF THE INVENTION

In accordance with one aspect of the invention, there is provided a construction apparatus including a body having a front, a rear, a top, a bottom, and first and second opposite sides. The front has a front surface having a plurality of block images configured to generally depict a plurality of courses of blocks, each of the courses having a respective course width. The first and second sides have generally complementary step shapes including at least two rises and at least one run between the rises, each rise being about equal to one of the course widths or a sum of a plurality of the course widths.

Generally each of the block images in at least one of the courses may have a length approximately equal to an integer multiple of at least one of the course widths.

The block images may depict hewn rocks.

The block images may be arranged to depict dry-stacked hewn rocks.

The body may have a base colour, and the block images may be coloured differently from the base colour.

Each course may have a common course width.

At least one of the plurality of courses may include a plurality of sub-courses.

Each course and sub-course may include a plurality of the block images.

The run may be equal to one of the course widths or to a sum of a plurality of the course widths.

The top and bottom may each have a respective thickness extending generally from the front to the rear, and the thickness of the bottom may be greater than the thickness of the top.

The top may have first and second parallel spaced apart alignment projections.

The bottom may have first and second alignment recesses for receiving respective alignment projections of at least one generally vertically adjacent construction apparatus.

Forward edges of the first and second alignment projections may be in a first plane parallel to a rear surface on the rear of the body. Forward edges of the first and second alignment recesses may be in a second plane parallel to the rear surface. The first plane may be spaced apart from the second plane towards the rear surface.

The first and second alignment projections may be spaced apart by a spacing distance selected such that when adjacent apparatuses of the same type are positioned such that adjacent generally complementary ends of the construction apparatuses are engaged with each other, a distance between adjacent alignment projections on adjacent blocks may be approximately equal to the spacing distance.

The top surface may have a recess for holding a stabilizer operably configurable to impede toppling of the body when the body is resting on the bottom.

At least one of the first and second sides may have a handle formed therein. The handle may include a recess.

The rear may have at least one recess to reduce a mass of the body.

The rear may have a generally flat planar rear surface, and the first and second sides each may have at least two generally planar rear side surfaces extending at an obtuse angle to the generally flat planar rear surface.

The front surface may have a first side portion and a second side portion disposed adjacent the first and second opposite sides of the body respectively. The first side may have at least two generally flat planar front side surfaces extending generally perpendicularly to the first front side portion, and the second side may have at least two generally flat planar front side surfaces extending generally perpendicularly to the second front side portion.

The apparatus may include transition surfaces extending between respective adjacent front and rear side surfaces on each of the first and second sides.

The front surface may generally lie in a first plane, and the rear may have a generally flat planar rear surface that lies in a second plane. The first plane may extend at an angle to the second plane.

The front surface may be generally convex.

The front surface may be generally concave.

The plurality of courses may consist of six courses, each having a common course width. The first and second sides may have generally complementary steps defining six rises and five runs.

On each of the first and second sides, the five runs may be approximately the common course width or approximately double the common course width.

The top may have a thickness generally from the front to the rear that may be from about 1.5 times the common course width to about 6 times the common course width.

The top may have a thickness generally from the front to the rear that may be from about 1.5 times the common course width to about 2.0 times the common course width.

The top may have a thickness generally from the front to the rear that may be from about 3.0 times the common course width to about 6 times the common course width.

In accordance with a further aspect of the invention, there is provided a system including at least two construction apparatuses selected from a group. The group includes a first decorative construction apparatus including a first body having a first front, a first rear, a first top, a first bottom, and first and second opposite sides. The first front has a first surface having a first plurality of block images configured to generally depict a first plurality of courses of blocks, each course in the first plurality of courses having a respective course width. The first and second sides have generally complementary step shapes, the first side including at least first and second rises and at least a first run between the first and second rises, and the second side includes at least third and fourth rises and at least a second run between the third and fourth rises. Each of the first, second, third, and fourth rises are about equal to one of the course widths of the first plurality of courses or to a sum of a plurality of the course widths of the first plurality of courses. The group further includes a second decorative construction apparatus including a second body having a second front, a second rear, a second top, a second bottom, and third and fourth opposite sides. The second front has a second surface having a second plurality of block images configured to generally depict a second plurality of courses of blocks, each course in the second plurality of courses having a respective course width. The third and fourth sides have generally complementary step shapes, the third side including at least fifth and sixth rises and at least a third run between the fifth and sixth rises, and the fourth side including at least seventh and eighth rises and at least a fourth run between the seventh and eighth rises, each of the fifth, sixth, seventh, and eighth rises being about equal to one of the course widths of the second plurality of courses or to a sum of a plurality of the course widths of the second plurality of courses. The second top surface has a recess for receiving a stabilizer to prevent toppling of the second construction apparatus. The group further includes a third decorative construction apparatus including a third body having a third front, a third rear, a third top, a third bottom, and fifth and sixth opposite sides. The third front has a third surface having a third plurality of block images configured to generally depict a third plurality of courses of blocks, each course in the third plurality of courses having a common course width. The fifth and sixth sides have generally complementary step shapes, the fifth side including at least ninth and tenth rises and at least a fifth run between the ninth and tenth rises, and the sixth side including at least eleventh and twelfth rises and at least a sixth run between the eleventh and twelfth rises, each of the ninth, tenth, eleventh, and twelfth rises being about equal to the common course width or to an integer multiple of the common course width. The third top has a thickness generally from the third front to the third rear of from about 3.0 times the common course width to about 6 times the common course width. The at least two construction apparatuses are disposed adjacent each other such that adjacent sides of the at least two construction apparatuses are complementarily engaged to form a wall.

In accordance with another aspect of the invention, there is provided a process for making a construction apparatus, the process involving arranging a plurality of block image templates in a plurality of courses having respective course widths, in a form operably configured to define a body having a front, a rear, a top, a bottom, and first and second opposite sides that have generally complementary step shapes including at least two rises and at least one run between the rises, each rise being about equal to one of the course widths or a sum of a plurality of the course widths. The method further involves placing a moldable material into the form and on the block image templates and causing the moldable material to solidify in the form to define the body such that the front of the body has a surface having a plurality of block images defined by the block image templates. The block images generally depict a plurality of courses of blocks, each of the courses having a respective the course width.

Placing a moldable material may involve placing an uncured concrete mix into the form and on the block image templates.

The method may also involve placing a colored slurry on at least one of the block image templates prior to placing the concrete mix into the form, such that the colored slurry infuses into the uncured concrete mix to color the uncured concrete in contact with the at least one of the block image templates.

The method may further involve placing a tapered spacer in the form before arranging the block image templates, and arranging the block image templates may involve arranging the block image templates on the tapered spacer, such that the front surface of the body generally lies in a first plane extending at an angle to a second plane, wherein a generally flat planar rear surface of the rear of the body generally lies in the second plane.

The method may further involve placing at least one spacer in the form prior to placing the block templates such that the at least one spacer is located adjacent a top forming portion of the form such that the body formed by the form has a top thickness that is less than a bottom thickness of the body.

The method may further involve placing at least one spacer under at least some of the courses of the block image templates, such that each course is spaced from a bottom of the form a different distance so that the body has a greater thickness near the bottom than near the top.

Placing at least one spacer under at least some of the courses may involve placing a plurality of spacers such that each course may be associated with a respective spacer size.

In accordance with another aspect of the invention, there is provided a base apparatus for supporting a construction apparatus. The base apparatus includes a plate having a top, a bottom, a front, a rear, and first and second opposite sides. The top includes a generally planar surface having a front support region proximate the front for supporting the construction apparatus and a rear retaining region proximate the rear for supporting material adjacent a rear of the construction apparatus. The base apparatus also includes at least one front stop projecting upwardly from the generally planar surface of the top, adjacent the front, for stopping the construction apparatus from sliding forward on the top, and at least one rear retainer projecting upwardly from the generally planar surface of the top, adjacent the rear, for retaining material closely adjacent the construction apparatus when the construction apparatus is installed on the support region. The first and second sides are wider adjacent the front than adjacent the rear.

The rear retainer may include first and second lateral projections extending laterally adjacent the first and second sides respectively.

The rear retainer may include a main portion extending between the first and second lateral projections The rear retainer may include first and second frangible portions connecting the first and second lateral portions respectively to the main portion.

The at least one stop may include first and second spaced apart stops adjacent the first and second opposite sides respectively.

The top may include at least one alignment projection extending outwardly from the top, the alignment projection being operably configured to be received in a generally complementary opening in the construction apparatus.

In accordance with another aspect of the invention, there is provided a wall system including a base apparatus and a construction apparatus on the base apparatus. The base apparatus includes a plate having a first top, a first bottom, a first front, a first rear, and first and second opposite sides. The first top includes a generally planar surface having a front support region proximate the first front for supporting the construction apparatus and a rear retaining region proximate the first rear for supporting material adjacent a rear of the construction apparatus. The base apparatus further includes at least one front stop projecting upwardly from the generally planar surface of the first top, adjacent the first front, for stopping the construction apparatus from sliding forward on the first top. The base apparatus also includes at least one rear retainer projecting upwardly from the generally planar surface of the first top, adjacent the first rear, for retaining material closely adjacent the construction apparatus when the construction apparatus is installed on the support region. The first and second sides are wider adjacent the first front than adjacent the first rear. The construction apparatus includes a body having a second front, a second rear, a second top, a second bottom, and third and fourth opposite sides. The second front has a front surface having a plurality of block images configured to generally depict a plurality of courses of blocks; each of the courses having a respective course width. The third and fourth sides have generally complementary step shapes including at least two rises and at least one run between the rises, each rise being about equal to one of the course widths or to a sum of a plurality of the course widths.

The wall system may further include fill material on the rear retaining region, such that the fill material exerts a force on the rear retaining region to resist rotation of the base apparatus about a horizontal axis.

The wall system may further include a conduit on the rear retaining region for draining water away from the wall system.

The wall system may further include fill material on the conduit, such that the fill material exerts a force on the conduit and the rear retaining region to resist rotation of the base apparatus about a horizontal axis.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
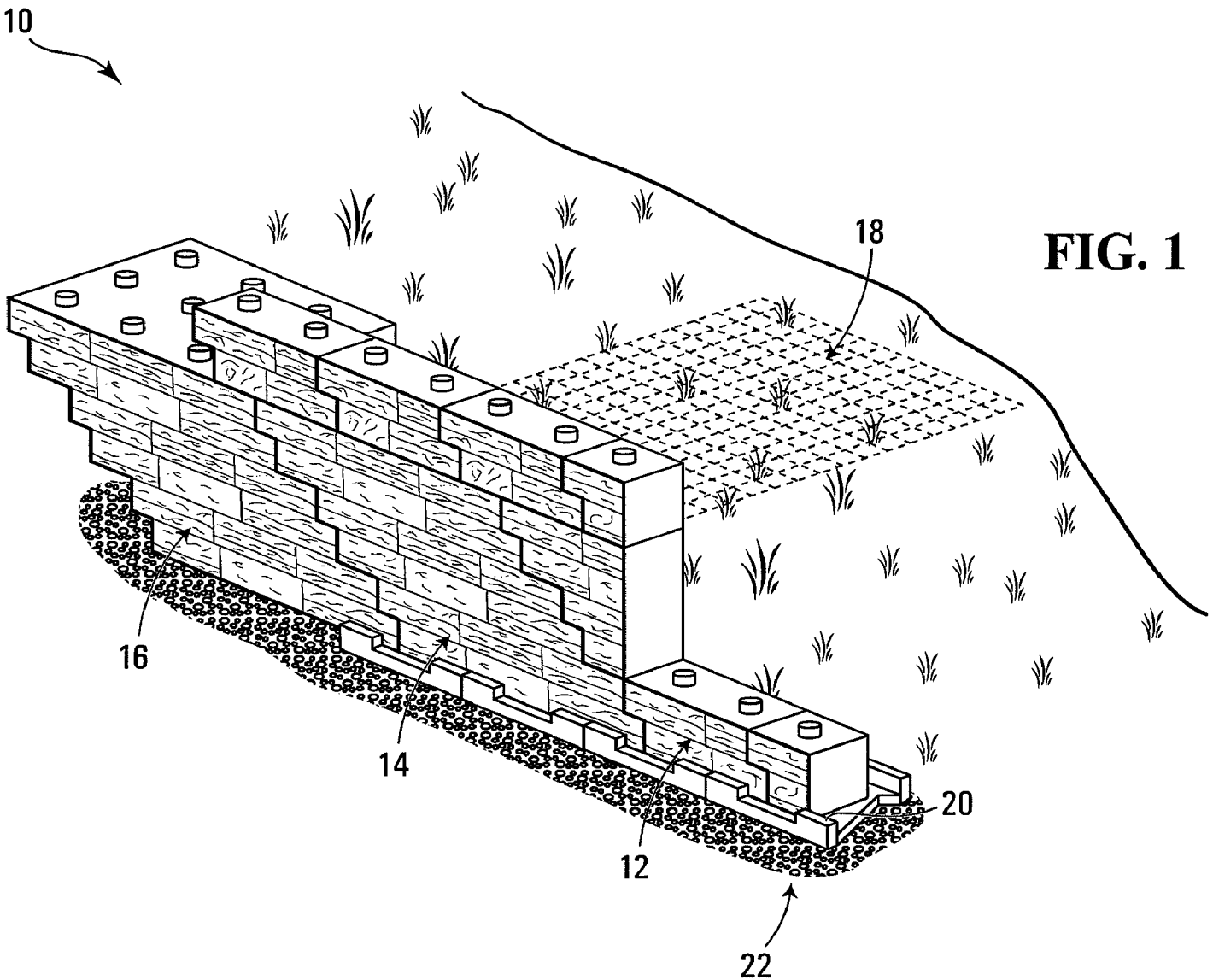
FIG. 1 is a front perspective view of a retaining wall system according to a first embodiment of the invention.

Referring to FIG. 1, a retaining wall system is shown generally at 10 and in this embodiment is comprised of a plurality of simple decorative construction apparatuses shown generally at 12, a plurality of engineered decorative construction apparatuses shown generally at 14, and at least one decorative gravity construction apparatus shown generally at 16.

Generally, each construction apparatus of the plurality of simple decorative construction apparatuses 12 is formed from concrete. The concrete is preferably a light weight concrete formed from pumice or cellular concrete, for example, to cause each construction apparatus to have a relatively low mass and therefore be relatively light weight. This makes the construction apparatus easily handled by a typical home owner for example, and it has been found that the reduced weight due to pumice or cellular concrete may reduce freight costs of the construction apparatuses by approximately 30% to 40%.

The engineered decorative construction apparatus shown generally at 14 is formed from standard concrete and is adapted to be used with a wall stabilizer such as geogrid 18 available from SRW Products of Princeton, Minn. or Nilex Inc. of Edmonton, Alberta, Canada, which helps prevent the wall from toppling outwardly. As illustrated in FIG. 1, the geogrid 18 preferably extends rearwardly of the wall system about 3 feet (1 m) or more depending on the type of fill, such as earth, sand, gravel, or other material behind the wall system so that the geogrid is held in place by the fill to stabilize the wall system.

The at least one decorative gravity construction apparatus 16 is formed from standard concrete, and generally has a wider depth than the engineered decorative construction apparatus 14 and the standard decorative construction apparatus 12 so that stabilizers such as geogrid 18 are not required and the construction apparatuses are essentially free standing. In the case of the decorative construction apparatuses 12 and the engineered decorative construction apparatuses 14, wall sections may be formed, to retain earth, sand, gravel, or other aggregates, for example. The decorative gravity construction apparatus 16 may also be used to retain these materials, although it need not rely on materials such as geogrid 18 for stability against toppling.

In the embodiment shown in FIG. 1, the decorative construction apparatuses 12 and the engineered decorative construction apparatuses 14 are disposed on a plurality of base apparatuses shown generally at 20 which may be placed on a previously prepared bed of compacted aggregate material such as gravel or the material commonly known as "three quarter minus" as shown at 22, for example. Desirably, a bed of such aggregate having a thickness of approximately six inches is provided and compacted using a plate compactor, for example. Also, the material 22 is desirably level, and preferably extends at least two feet behind the wall. The base apparatuses 20 are placed on the compacted bed of material 22 and the decorative and/or engineered construction apparatuses are placed on top of the base apparatuses as will be described further below. The decorative gravity construction apparatus 16 may be placed on a plurality of bases with or without a compacted bed of gravel but need not be. The decorative construction apparatuses 12 and the engineered decorative construction apparatuses 14 also need not be placed on the bases, but as will be appreciated below, it is desirable to do so.

Figure 2:
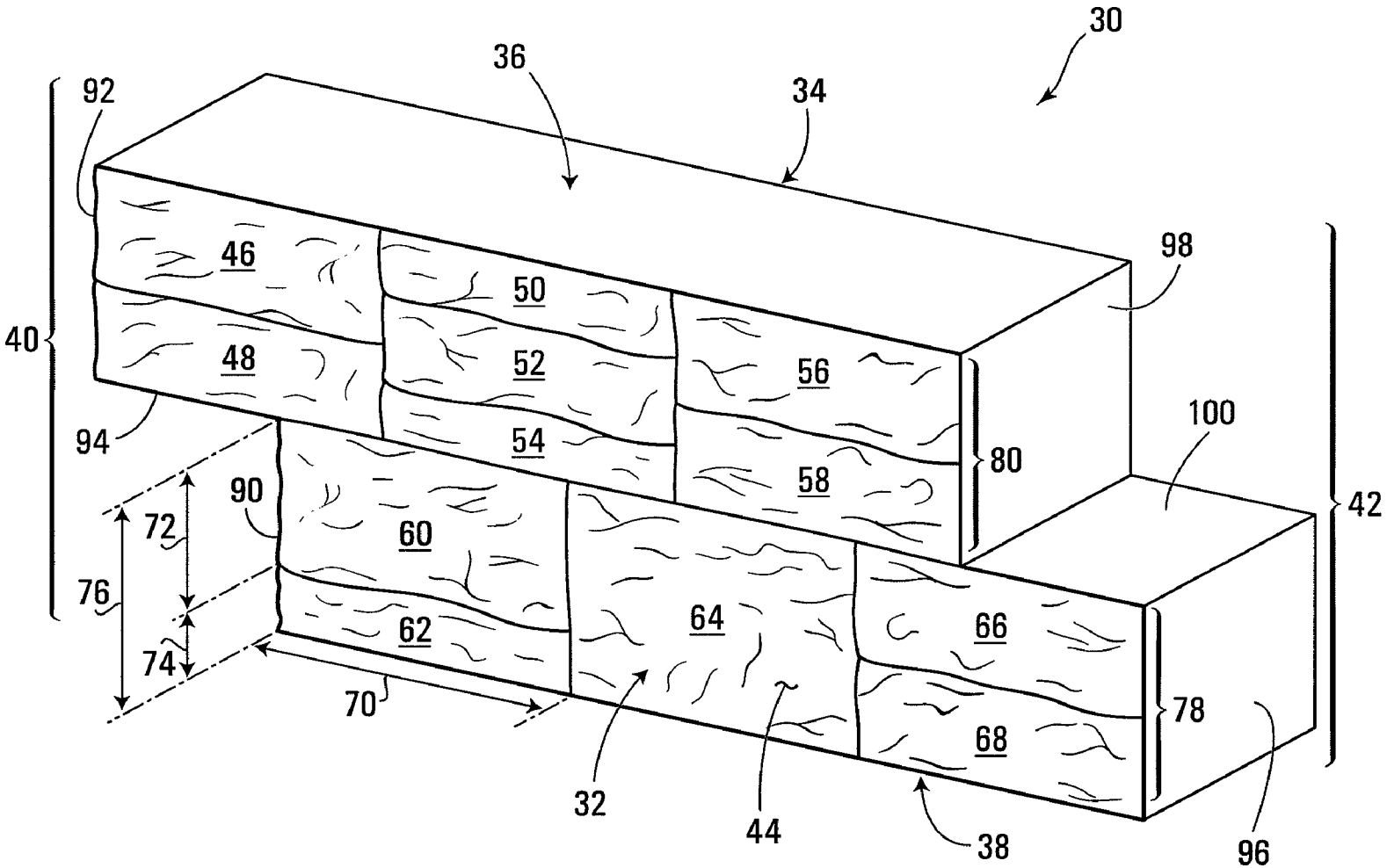
FIG. 2 is a front perspective view of a very basic embodiment of a decorative construction apparatus according to one embodiment of the invention.

Referring to FIG. 2, a very basic embodiment of a decorative construction apparatus comprises a body shown generally at 30 having a front 32, a rear 34, a top 36, a bottom 38, and first and second opposite sides shown generally at 40 and 42 respectively.

The front 32 has a front surface 44 having a plurality of block images 46, 48, 50, 52, 54, 56, 58, 60, 62, 64, 66, and 68 configured to generally depict a plurality of courses of blocks, each of the courses of blocks having a respective course width. For example, each block image may depict one or more hewn rocks and the block images may be arranged to depict dry-stacked hewn rocks. The phrase "dry-stacked" herein refers to rocks or other blocks that generally appear to be stacked without visible mortar lines therebetween. Each of the images has a length such as shown at 70 and a width such as shown at 72. The lengths 70 of each block image are not critical and may be virtually of any length within the confines of the outer perimeter of the body 30, although as will be appreciated below, selection of a suitable length can enhance the appearance of any wall formed by a plurality of the construction apparatuses. The widths 72, however, are selected such that a sum of widths, for example 72 and 74 of block images 60 and 62 respectively, that are positioned adjacent to each other vertically, define a common width 76 which defines a course width 76 of the images.

Thus, in general, the width of each block image is selected such that when the block images are placed adjacent each other in the configuration shown in FIG. 2, for example, they generally define a readily discernible course such as the course of block images shown at 78. Thus, in this embodiment, two courses of block images are shown at 78 and 80 respectively. It will be appreciated that at least one of the courses may include sub-courses for example, such as the sub-course formed by block images 48 and 58 and by block images 46 and 56, although these sub-courses are interrupted by intermediate block images 50, 52, and 54, for example, which help to cause the overall image seen on the front surface 44 to appear somewhat random. However, it is important that at least the two well defined courses 78 and 80 are provided by the arrangement of block images 46-68.

Still referring to FIG. 2, the first and second sides 40 and 42 of the body 30 have generally complementary step shapes comprising at least two rises and a first run between the rises. For example, the first and second rises on the first side 40 are shown at 90 and 92 and the at least one run is shown at 94. On the second side 42, third and fourth rises are shown at 96 and 98 and a second run is shown at 100. Each rise 90, 92, 96, and 98 is about equal to one of the course widths 76 or a sum of a plurality of the course widths. For example, if the block image 64 were replaced with two other block images the same as block images 66 and 68, then there would be two sub-courses and the sum of the widths of each of these sub-courses would provide an overall course width for the first course 78.

For aesthetic purposes, generally each of the block images in at least one of the courses 78 and 80 may desirably have a length approximately equal to an integer multiple of at least one of the course widths. For example, block images 46-58 have widths that are approximately 2 times the width of the associated course 80. Also desirably for aesthetic reasons, each course has a common course width, i.e., the course widths 78 and 80 are the same, although it will be appreciated that the course widths need not be the same in other embodiments.

In the embodiment shown in FIG. 2, the runs 94 and 100 are equal to the course widths 78 and 80. Desirably, but not necessarily, the runs are equal to one of these course widths or to a sum of a plurality of course widths. Thus, for example, where the course widths 78 and 80 are both four inches, in the embodiment shown, the runs 94 and 100 would also both be four inches.

Figure 3:
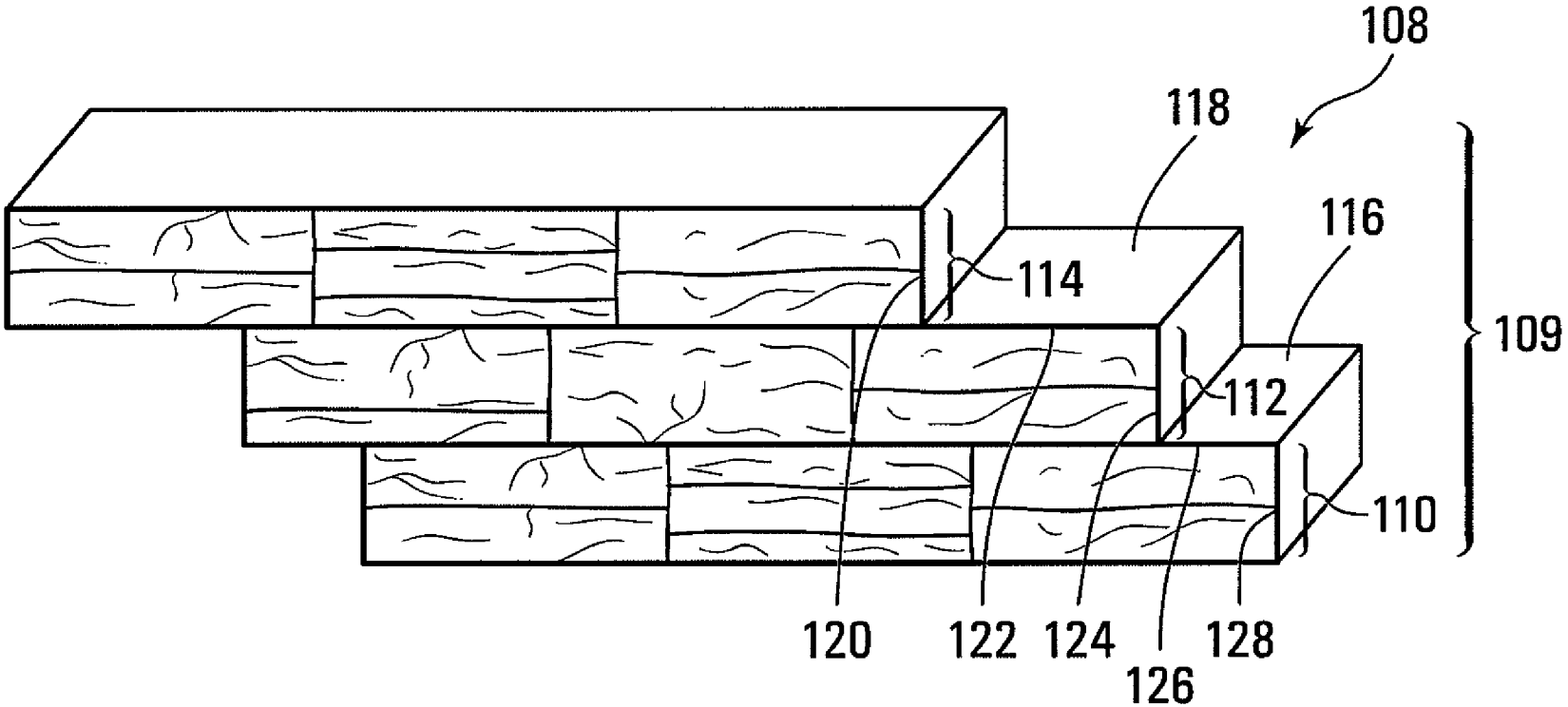
FIG. 3 is a front perspective view of a construction apparatus according to an alternative embodiment of the invention.

In an alternative embodiment such as shown at 108 in FIG. 3, the illustrated construction apparatus has a side 109 having three courses 110, 112, and 114 with a first run 116 that is equal to the common width of each of the courses 110, 112, and 114, and a second run 118 that is equal to twice the common course width of the courses 110, 112, and 114. An advantage to this configuration is that when a side of an adjacent construction apparatus is engaged with the side shown at 109, edges 120, 122, 124, 126, and 128 are difficult to discern because the eye generally expects to see a regular pattern of edges between adjacent construction apparatuses. With the individual block images being about twice the width of the course width, for example, the block images themselves appear to define edges similar to edges 120-128 all across the front surface of the apparatus and therefore the edges 120-128 tend to blend in to the edges provided by the block images defining each course, especially when the wall is viewed from a distance.

In FIG. 2 the top 36 and bottom 38 of the body 30 have approximately the same thickness, where thickness is measured from the front surface 44 to a surface on the rear 34.

Figure 4:
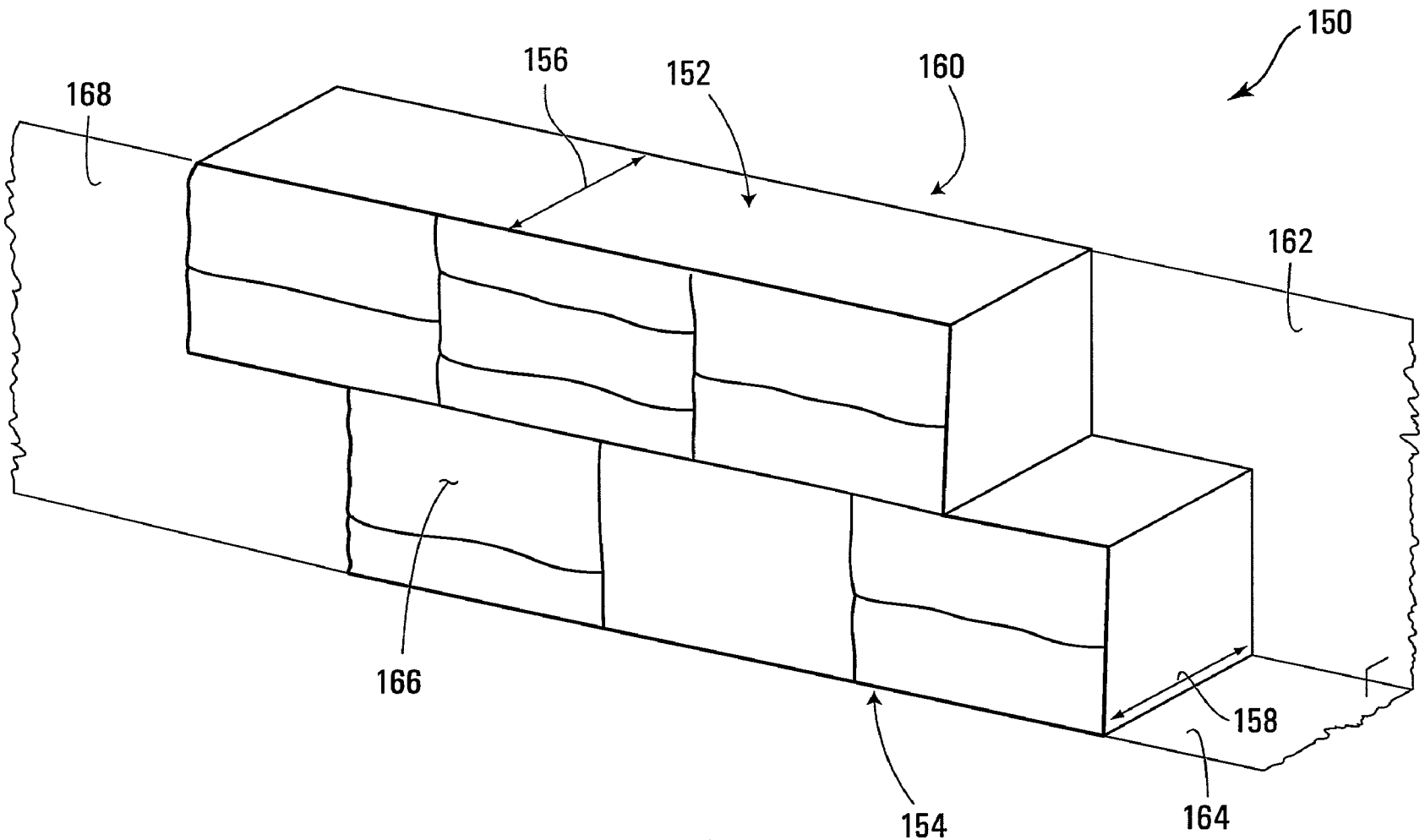
FIG. 4 is a front perspective view of a construction apparatus according to a further alternative embodiment of the invention.

Referring to FIG. 4, a construction apparatus according to a further embodiment of the invention is shown generally at 150 and is generally the same as the construction apparatus 30 shown in FIG. 2, but includes a top 152 and a bottom 154 that have different thicknesses. In particular, the top 152 has a thickness depicted by arrow 156 that is less than a thickness depicted by arrow 158 of the bottom 154. Thus, in the embodiment shown in FIG. 4, the top 152 and bottom 154 of the construction apparatus each have a respective thickness extending generally from the front to the rear of the construction apparatus and the thickness of the bottom is greater than the thickness of the top.

Figure 5:
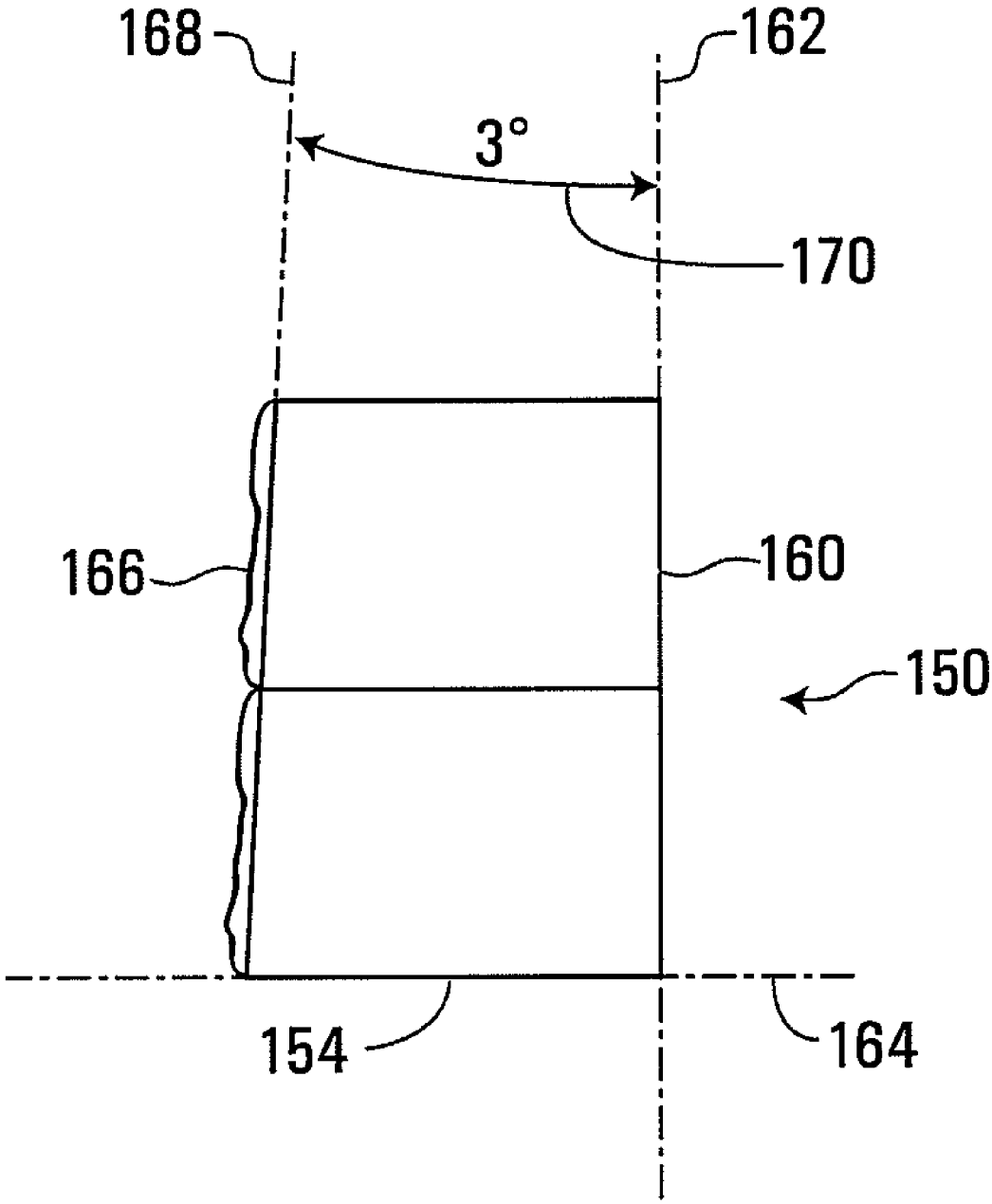
FIG. 5 is a side elevation view of the construction apparatus of FIG. 4.
Figure 6:
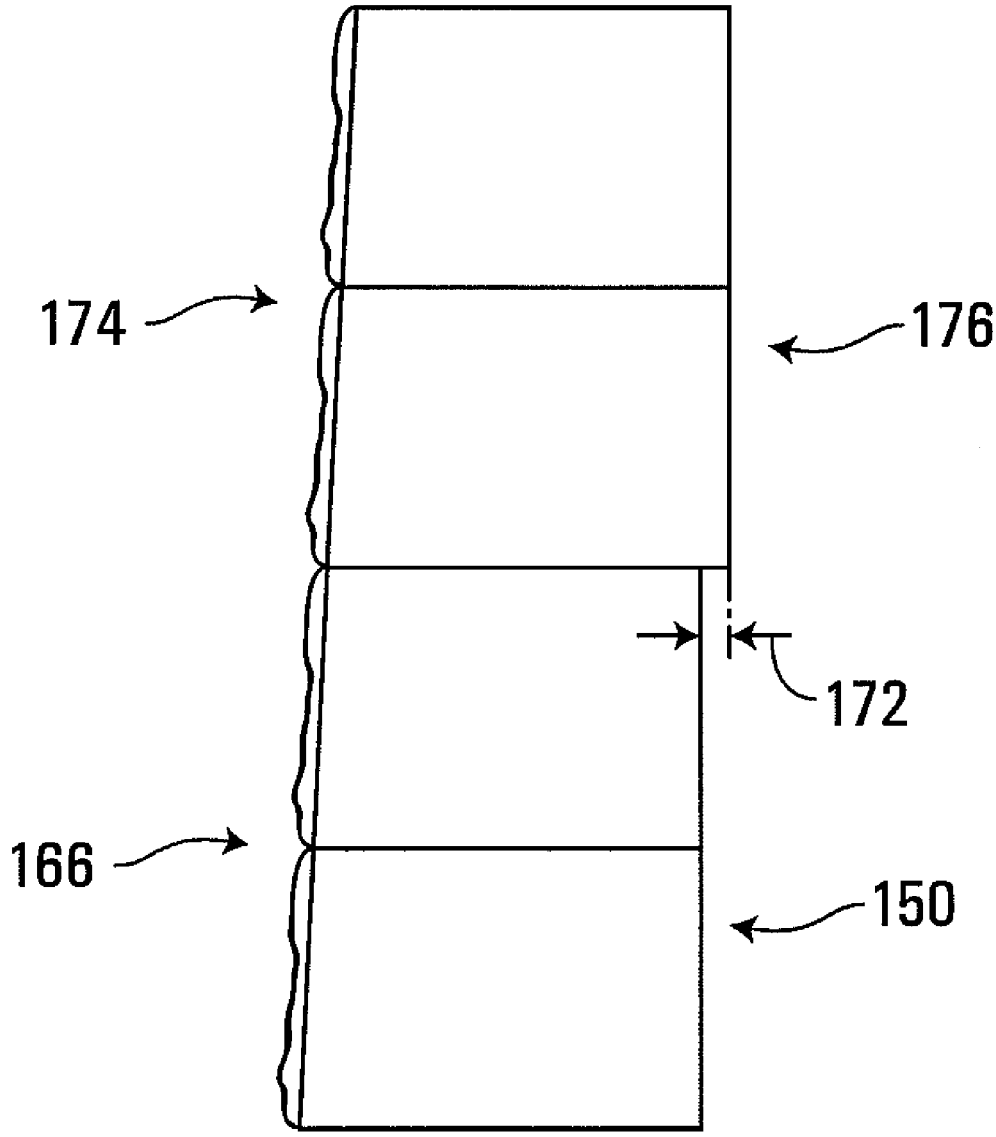
FIG. 6 is a side elevation view of a system of construction apparatuses of the type shown in FIG. 4.

Referring to FIG. 5, in this embodiment, the construction apparatus has a rear 160 having a generally flat planar surface that lies in a first plane 162 and the bottom 154 has a generally flat planar surface that lies in a second plane 164 which is disposed at right angles to the first plane 162. The front surface 166 of the construction apparatus 150 has a plurality of block images and is generally disposed in a third plane 168 which is disposed at an angle of approximately three degrees to the first plane 162 as shown at 170 in FIG. 5. The purpose of this angle 170 is to cause successively higher rows of construction apparatuses to have a setback such as shown at 172 in FIG. 6 when a front 174 of a second construction apparatus 176 is placed generally coplanarly with the front surface 166 of the first construction apparatus 150 when the second construction apparatus 176 is placed on top of the first construction apparatus 150.

Figure 7:
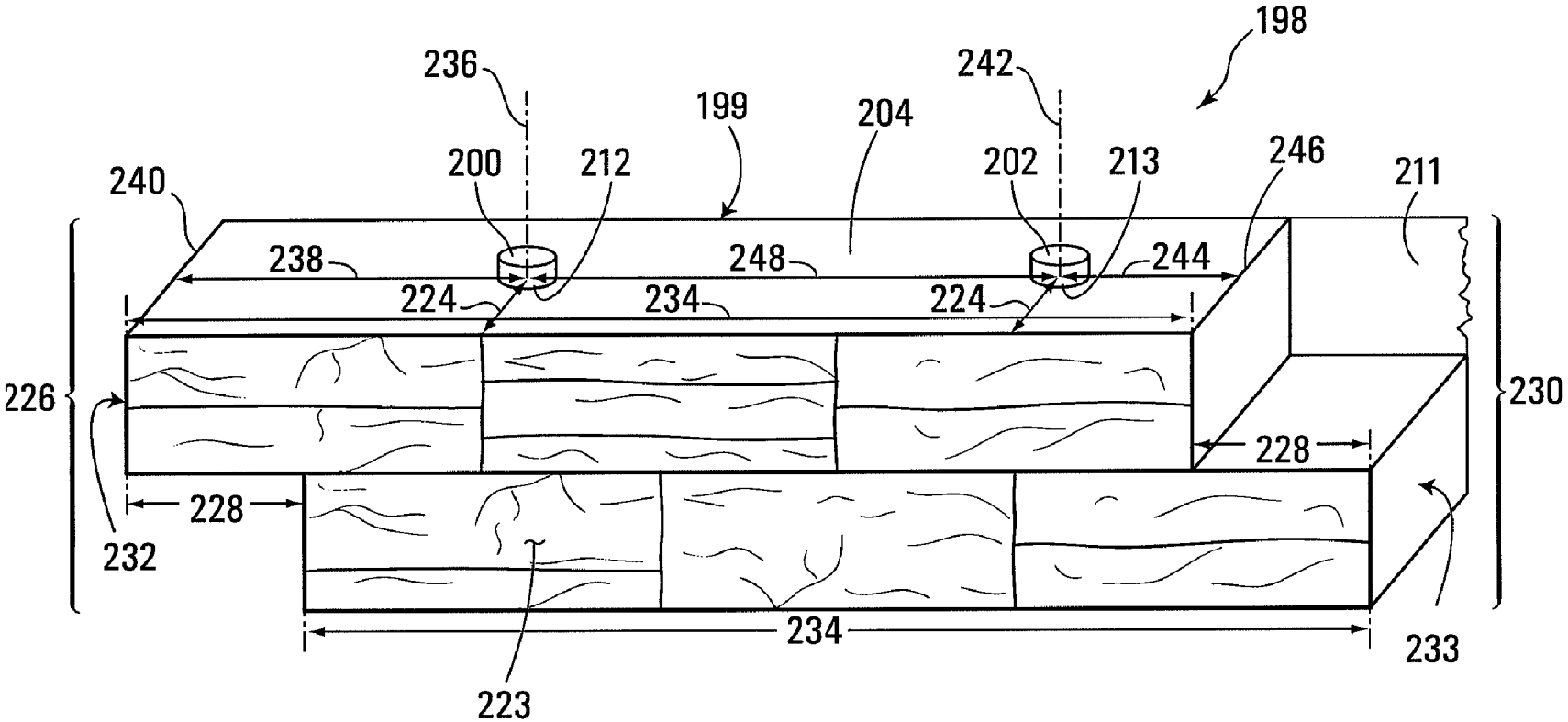
FIG. 7 is a front perspective view of a construction apparatus according to a further alternative embodiment of the invention.

Referring to FIG. 7, a construction apparatus in accordance with a further embodiment of the invention is shown generally at 198. The construction apparatus 198 is generally the same as the construction apparatus 150, except that to facilitate alignment of the successive rows of construction apparatuses, first and second alignment projections 200 and 202 are provided on a top surface 204 of the construction apparatus 198 in parallel spaced apart relation. In addition, referring to FIG. 8, a bottom 206 of the construction apparatus 198 is provided with first and second alignment recesses 208 and 210 respectively. The first and second alignment recesses 208 and 210 are positioned for receiving the first and second alignment projections 200 and 202 of FIG. 7 of at least one generally vertically adjacent construction apparatus, although the alignment recesses preferably receive alignment projections from two vertically adjacent construction apparatuses, as illustrated in FIG. 9, for example. In other words, the first and second alignment projections 200 and 202 of a lower construction apparatus are received in respective alignment recesses of respective upper construction apparatuses placed on top of the lower construction apparatus.

Figure 8:
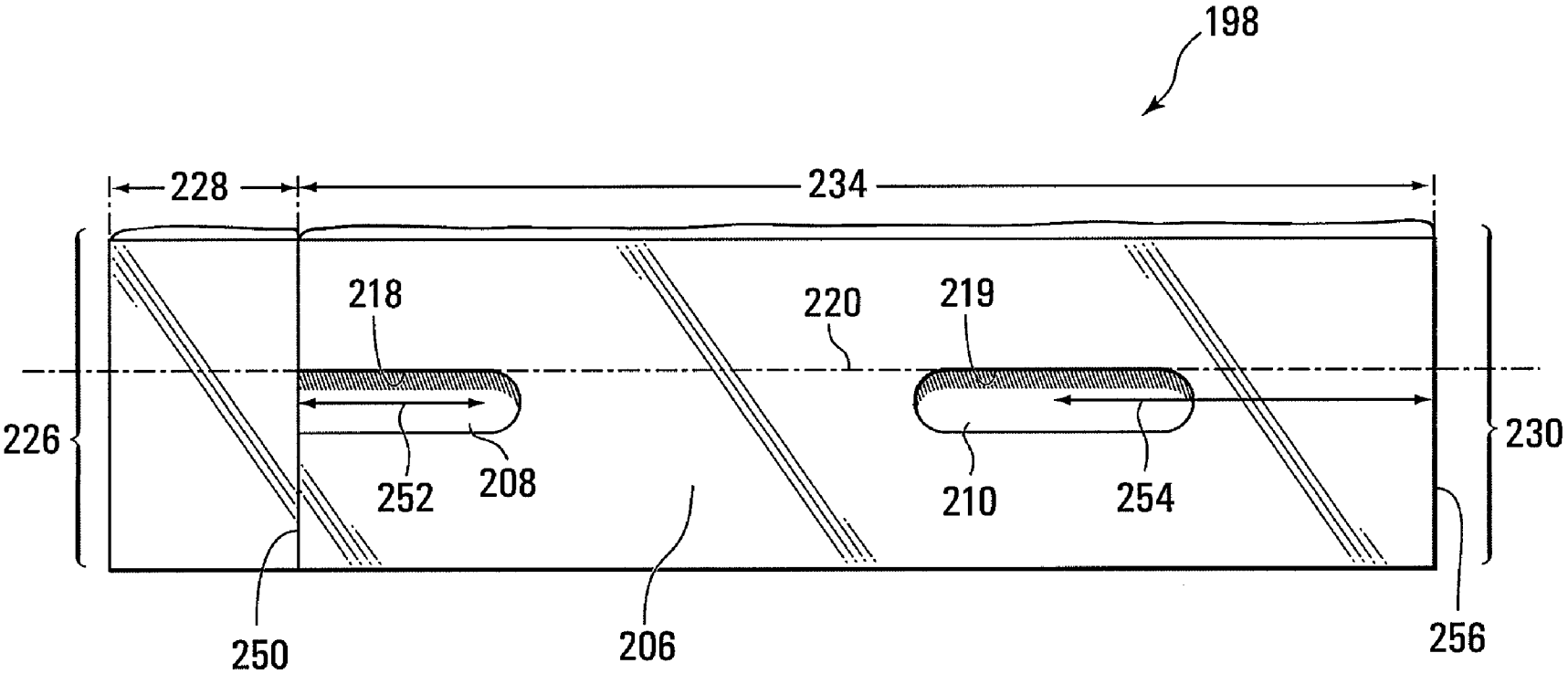
FIG. 8 is a bottom plan view of the construction apparatus of FIG. 7.
Figure 9:
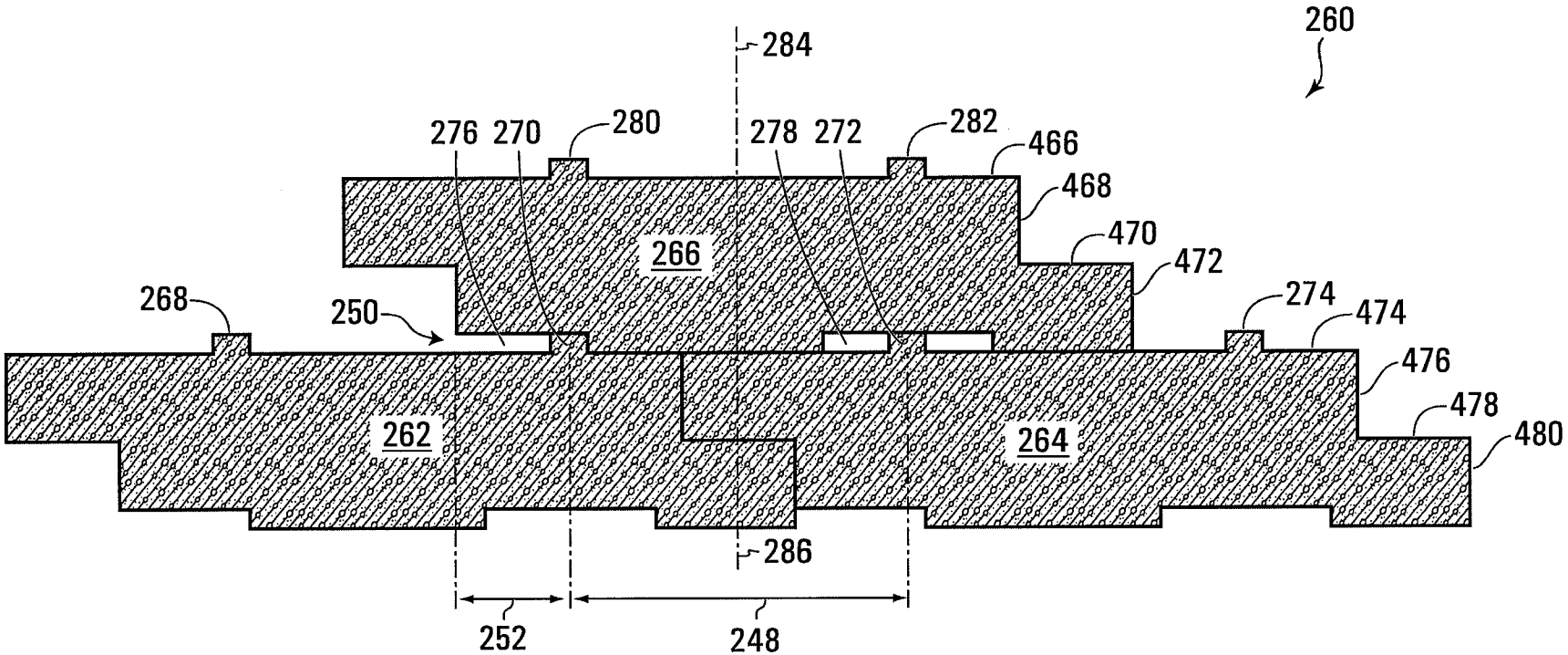
FIG. 9 is a cross sectional view of a system of construction apparatuses according to another embodiment of the invention.
Figure 37:
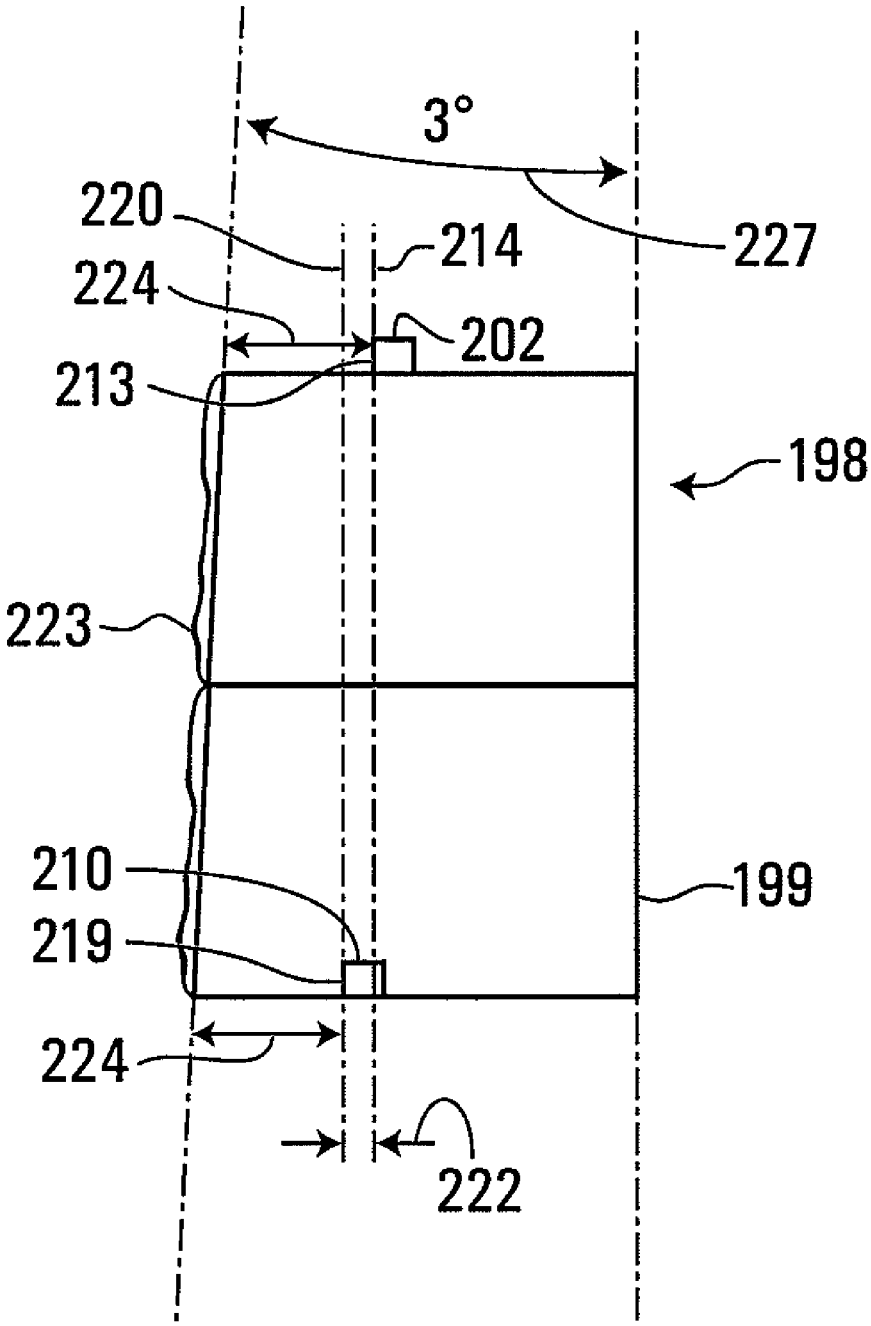
FIG. 37 is a side elevation view of the construction apparatus of FIG. 7.

Referring to FIGS. 7, 8, and 37, the construction apparatus 198 has a rear 199 having a generally flat planar surface that lies in a first plane 211. A front edge 212 (shown in FIG. 7) of the first alignment projection 200 and a front edge 213 of the second alignment projection 202 are generally in a second plane 214 parallel to the first plane 211. Also, a front edge 218 of the first alignment recess 208 and a front edge 219 of the second alignment recess 210 are generally in a third plane 220 also parallel to the first plane 211. The second plane 214 is spaced apart from the third plane 220 by a distance 222 towards the rear 199 of the construction apparatus 198. The front edges 212 and 213 of the alignment projections 200 and 202 and the front edges 218 and 219 of the alignment recesses 208 and 210 are generally a common distance 224 from the front surface 223. Therefore, when a second similar construction apparatus is placed above the construction apparatus 198, the alignment projections 200 and 202 are received in the alignment recesses 208 and 210 causing the upper construction apparatus to be set back from the lower construction apparatus by the distance 222. Advantageously, the front surface 223 is generally in a plane 225 at an angle 227 of about 3 degrees from the first plane 211, so that the front surfaces 223 of adjacent construction apparatuses appear generally contiguous in spite of the set back distance 222.

Referring to FIG. 7, a first side 226 of the construction apparatus 198 includes a run having a distance 228, and a second side 230 also has a run having the distance 228. The first and second courses 232 and 233 respectively each have a length equal to a distance 234 so that the construction apparatus 198 has an overall length of the sum of the distances 228 and 234. In the illustrated embodiment, a centre 236 of the first alignment projection 200 is a distance 238 from a top edge 240 of the first side 226, where the distance 238 is generally one quarter of the distance 234 plus one half of the distance 228, and a centre 242 of the second alignment projection 202 is a distance 244 from a top edge 246 of the second side 230, where the distance 244 is generally one quarter of the distance 234 less one half of the distance 228. Therefore, the first and second alignment projections 200 and 202 respectively are spaced apart by a spacing distance 248 equal to half of the distance 234. In one embodiment, the distance 234 is approximately twenty-four inches and the distance 228 is approximately four inches, such that the distance 238 is approximately eight inches, the distance 244 is approximately four inches, and the distance 248 is approximately twelve inches.

One advantage of the alignment projection spacing described above is that when adjacent construction apparatuses such as the construction apparatus 198 are positioned such that horizontally adjacent generally complementary ends of the construction apparatuses are engaged with each other, the distance between adjacent alignment projections on the horizontally adjacent construction apparatuses is approximately equal to the distance 248, such that the alignment projections on the horizontally adjacent construction apparatuses are generally equally spaced horizontally.

Referring to FIG. 8, the first alignment recess 208 extends from a bottom edge 250 of the first side 226 so that a centre of an alignment projection received therein will be a pre-determined distance 252 from the bottom edge 250, where the distance 252 is a quarter of the distance 234 less half of the distance 228. Also, in the illustrated embodiment, the second alignment recess 210 extends longitudinally in the bottom 206 of the construction apparatus 198 so that an alignment projection of a lower construction apparatus may be received therein and may slide longitudinally therein to allow for a considerable amount of travel of the alignment projection of a lower construction apparatus in the second alignment recess 210 of the construction apparatus immediately above. A centre of the second alignment recess 210 is a distance 254 from a lower edge 256 of the second side 230, and the distance 254 is generally a quarter of the distance 234 plus half of the distance 228.

As will become apparent from the discussion below with reference to FIG. 9, the configuration of alignment projections and recesses described above may advantageously provide for a wall system having desirable stability resulting from vertical alignment of alignment projections, and from a system wherein the centre of mass of a construction apparatus is generally above or below the centre of a joint between vertically adjacent construction apparatuses.

Referring to FIG. 9, a system comprising a first construction apparatus 262, a second construction apparatus 264, and a third construction apparatus 266, all of the simple decorative type, is shown generally at 260. The first construction apparatus 262 has first and second alignment projections 268 and 270 respectively, as illustrated above with reference to FIG. 7. The second construction apparatus has first and second alignment projections 272 and 274, also as shown above with reference to FIG. 7. The third construction apparatus has first and second alignment recesses 276 and 278 respectively, and first and second alignment projections 280 and 282 respectively, as illustrated above with reference to FIG. 7 and FIG. 8. As illustrated in FIG. 9, the first and second construction apparatuses 262 and 264 respectively are positioned such that their generally complementary ends are engaged with each other, and by virtue of the positioning of the alignment recesses discussed above with reference to FIG. 7, the second alignment projection 270 of the first construction apparatus 262 and the first alignment projection 272 of the second construction apparatus 264 are generally spaced apart by the spacing distance 248 illustrated in FIG. 7. Advantageously, the arrangement of alignment projections illustrated in FIG. 7 thus permits an assembly of construction apparatuses having generally equally spaced alignment projections, as shown in FIG. 9.

Still referring to FIG. 9, the second alignment projection 270 of the first construction apparatus 262 is received in the first alignment recess 276 of the third construction apparatus 266 such that a centre of the alignment projection 270 is distance 252 from the bottom edge 250 of the third construction apparatus 266. Advantageously, as illustrated in FIG. 9, the first and second alignment projections 280 and 282 respectively of the third construction apparatus 266 are generally positioned above the second alignment projection 270 of the first construction apparatus 262 and the first alignment projection 272 of the second construction apparatus 264 respectively. Thus, advantageously, a system of construction apparatuses such as the system 260 shown in FIG. 9 will generally have alignment projections generally positioned above and below each other. Furthermore, a centre of mass generally along the line 284 of the third construction apparatus 266 is positioned generally above a line 286 generally through a centre of a joint between the first and second construction apparatuses 262 and 264 respectively. It has been found that positioning the centre of mass of one construction apparatus generally above or below the centre of a joint formed by two vertically adjacent construction apparatuses forms a particularly stable wall.

Figure 30:
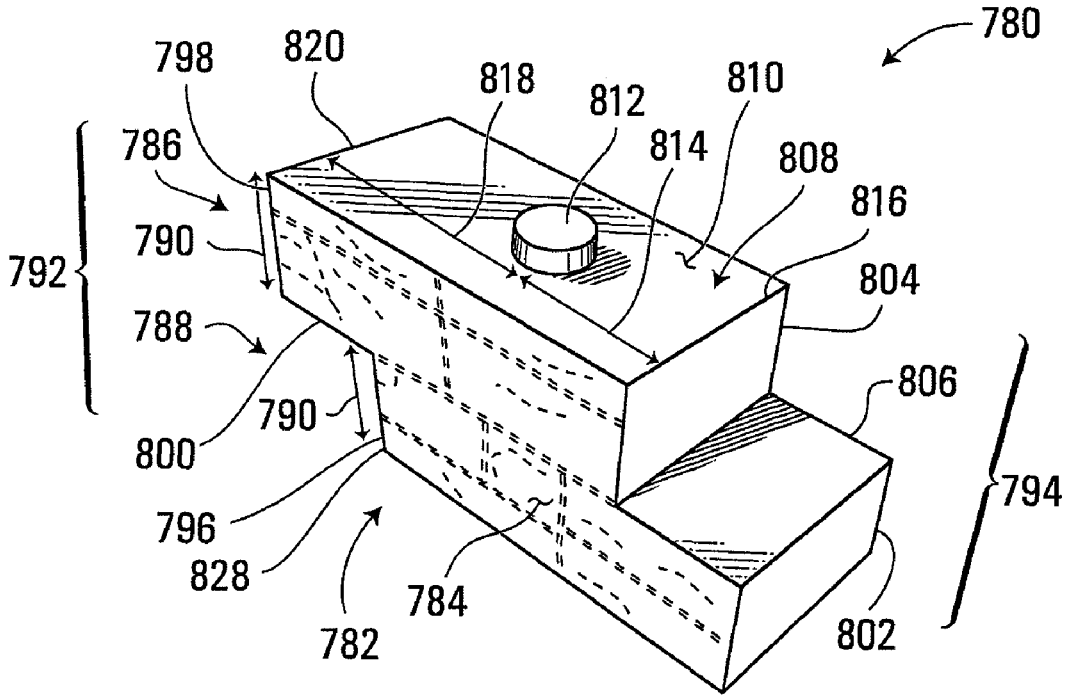
FIG. 30 is a front perspective view of a construction apparatus according to a further alternative embodiment of the invention.

Referring to FIG. 30, a construction apparatus according to a further embodiment of the invention is shown generally at 780. The construction apparatus 780 has a configuration generally similar to the construction apparatus 198 illustrated in FIGS. 7 and 8, although the construction apparatus may be referred to as a "half block", in contrast to the construction apparatus 198 that may be referred to as a "full block", because the construction apparatus 780 generally occupies half the length of the construction apparatus 198.

The construction apparatus 780 has a front shown generally at 782 having a front surface 784 depicting a plurality of block images in two courses shown generally at 786 and 788. The courses have a common course width 790.

The construction apparatus 780 has a first side 792 and a second opposite side 794. The first side 792 has a first rise 796 and a second rise 798, and a first run 800 between the first and second rises, and the second side 794 has a third rise 802 and a fourth rise 804, and a second run 806 between the third and fourth rises, each of the rises and runs being generally equal to the common course width 790.

The construction apparatus 780 also has a top shown generally at 808 having a top surface 810 having an alignment projection 812 projecting therefrom. A centre of the alignment projection 812 is a distance 814 from a top edge 816 of the second side 794, and in the illustrated example, the distance 814 is generally equal to the common course width 790. The alignment projection 812 is also a distance 818 from an upper edge 820 of the first side 792, and in the illustrated example, the distance 818 is generally twice the common course width 790.

Figure 31:
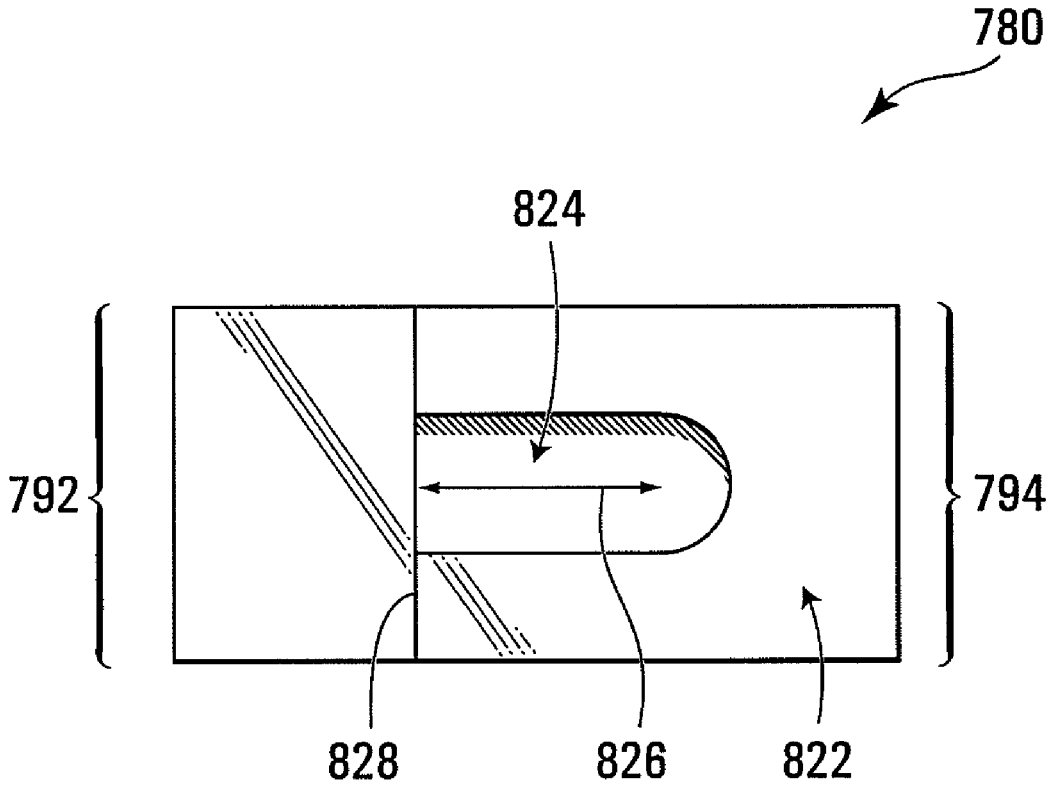
FIG. 31 is a bottom plan view of the construction apparatus of FIG. 30.

Referring to FIG. 31, the construction apparatus 780 further includes a bottom shown generally at 822 having an alignment recess 824 therein. The alignment recess 824 is configured to receive an alignment projection, such that a centre of the alignment projection can be received a distance 826 from a lower edge 828 of the first side 792. In the illustrated example, the distance 826 is generally equal to the common course width 790. Therefore, it will be appreciated that the construction apparatus 780 may be considered to be "half" of the construction apparatus 198 described with reference to FIGS. 7 and 8, such that two "half block" construction apparatuses 780 with their generally complementary sides engaged have generally the same function as one construction apparatus 198. Advantageously, the construction apparatus 780 may be beneficial in the construction of a wall system where it is desirable to include construction apparatuses having a shorter length.

Figure 32:
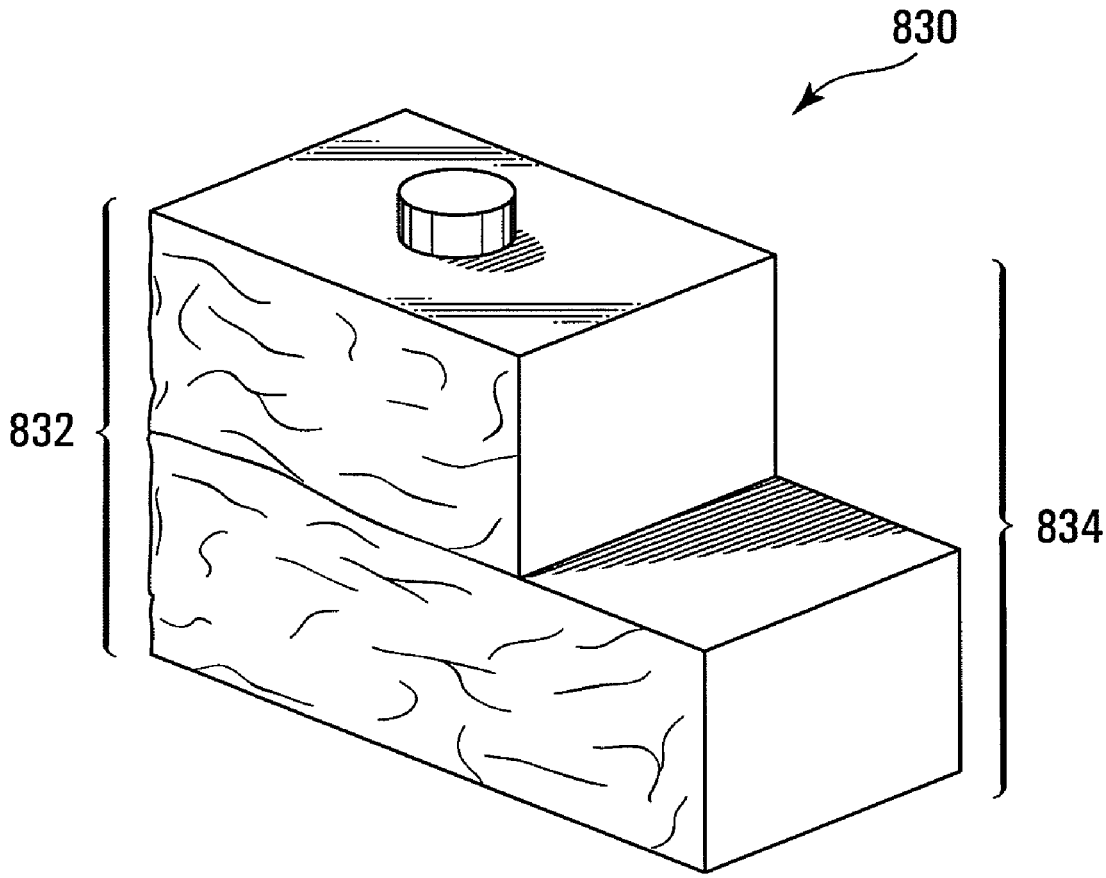
FIG. 32 is a front perspective view of a construction apparatus according to a further alternative embodiment of the invention.

Referring to FIG. 32, a left end construction apparatus in accordance with a further embodiment of the invention is shown generally at 830. The left end construction apparatus 830 includes a first generally continuous flat planar side 832 (although the first side may depict a plurality of block images) and a second opposite side 834. The second side 834 has a generally complementary step shape as discussed above in connection with the apparatus shown in FIG. 2. It will be appreciated that the left end construction apparatus 830 may be used at a left end of a wall system formed of at least one "full block" of the type shown in FIG. 2, for example, in order to provide a generally vertical left end to the wall system.

Figure 33:
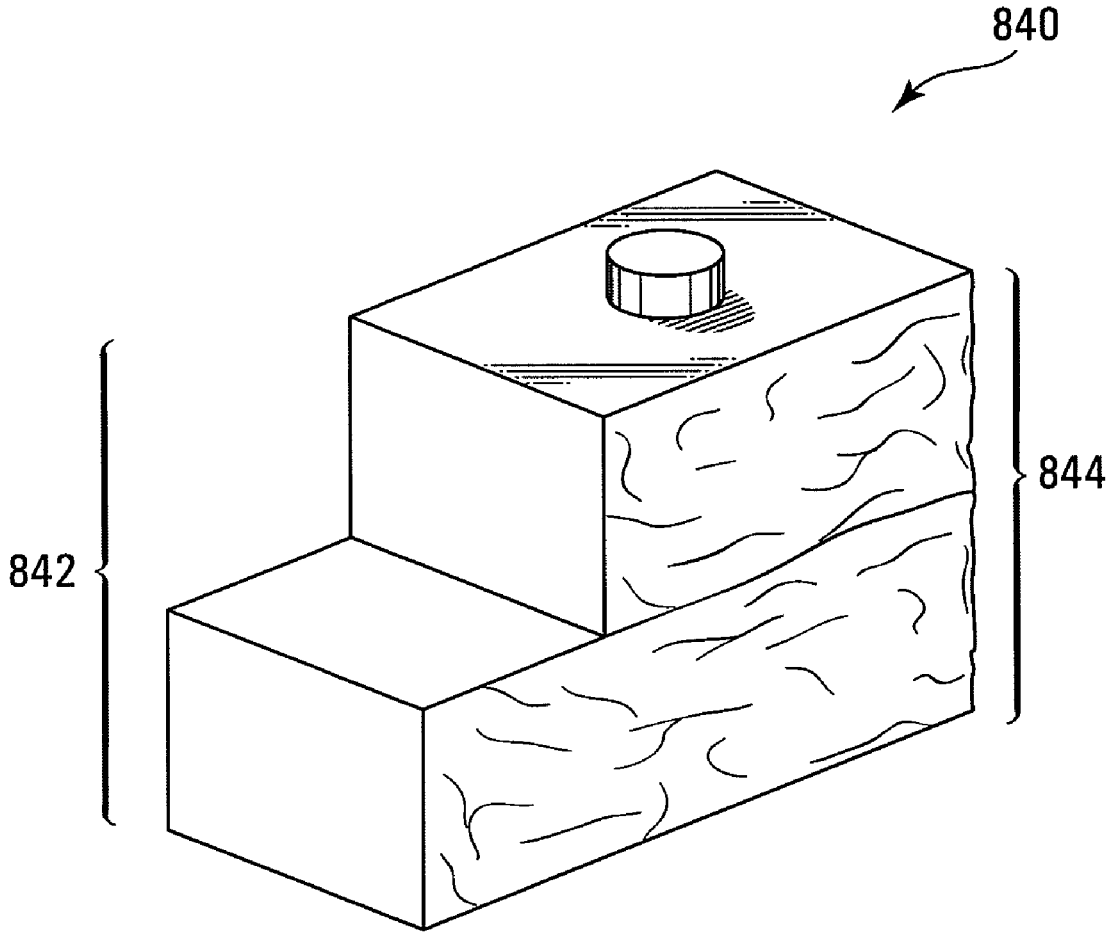
FIG. 33 is a front perspective view of a construction apparatus according to a further alternative embodiment of the invention.

Referring to FIG. 33, a right end construction apparatus according to a further embodiment of the invention is shown generally at 840. The right end construction apparatus 840 includes a first side 842 having a generally complementary step shape as discussed above, and a second opposite generally vertical side 844. The second side 844 may depict a plurality of block images. It will be appreciated that the right end construction apparatus 840 may be advantageous in a wall system in order to provide a right end of the wall system having a generally vertical surface.

Figure 34:
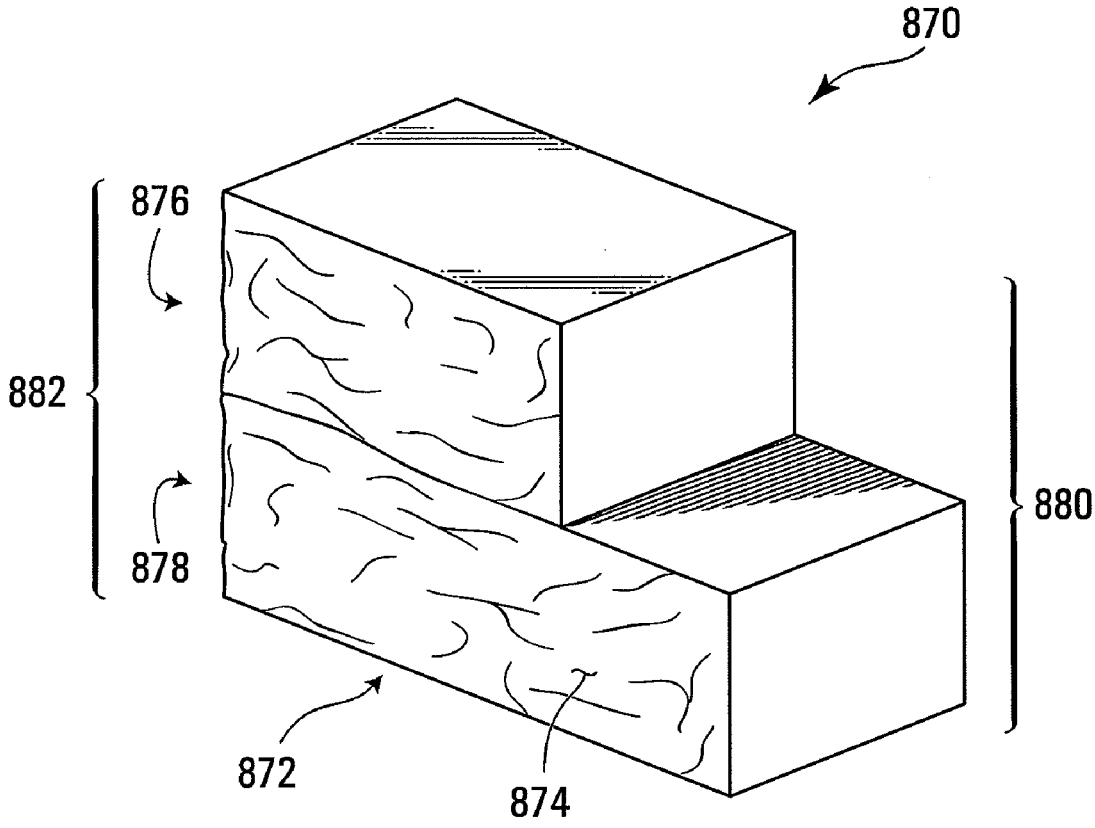
FIG. 34 is a front perspective view of a construction apparatus according to a further alternative embodiment of the invention.

Referring to FIG. 34, a construction apparatus according to a further embodiment of the invention is shown generally at 870. The construction apparatus 870 includes a front shown generally at 872 having a front surface 874 having a plurality of block images configured to generally depict blocks in two courses shown generally at 876 and 878. The construction apparatus includes a first side 880 having a generally complementary step shape as discussed herein, and a second side 882 opposite the first side 880.

Figure 35:
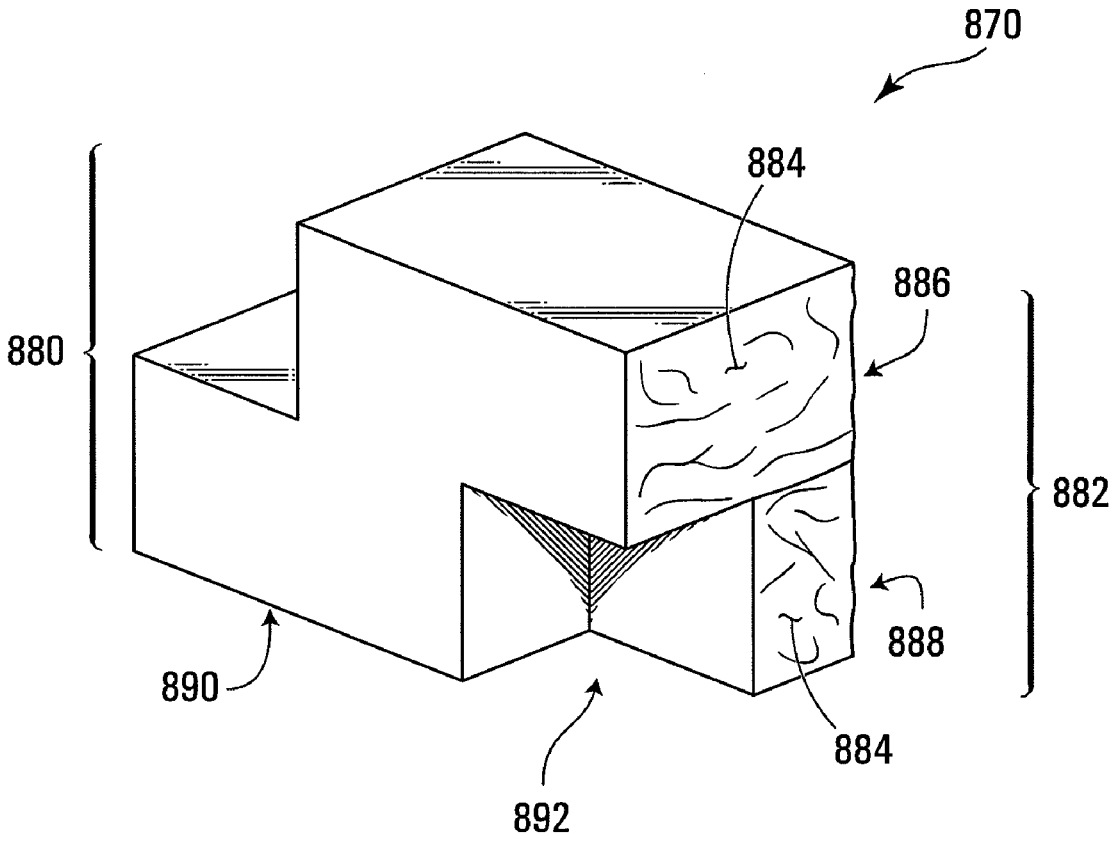
FIG. 35 is a rear perspective view of the construction apparatus of FIG. 34.

Referring to FIG. 35, the second side 882 includes a side surface 884 also having a plurality of block images configured to generally depict blocks in two courses shown generally at 886 and 888, and the courses 876 and 878 are generally contiguous with the courses 886 and 888 respectively. Still referring to FIG. 35, the construction apparatus 870 includes a rear shown generally at 890. The rear includes a recess shown generally at 892 that provides a generally complementary step shape as discussed herein. Accordingly, it will be appreciated that the construction apparatus 870 may be referred to as a "corner block" or as a "corner construction apparatus", because the first side 880 and the rear 890 have generally complementary step shapes for engagement with adjacent construction apparatuses (not shown), the adjacent construction apparatuses being at generally right angles to each other.

Figure 10:
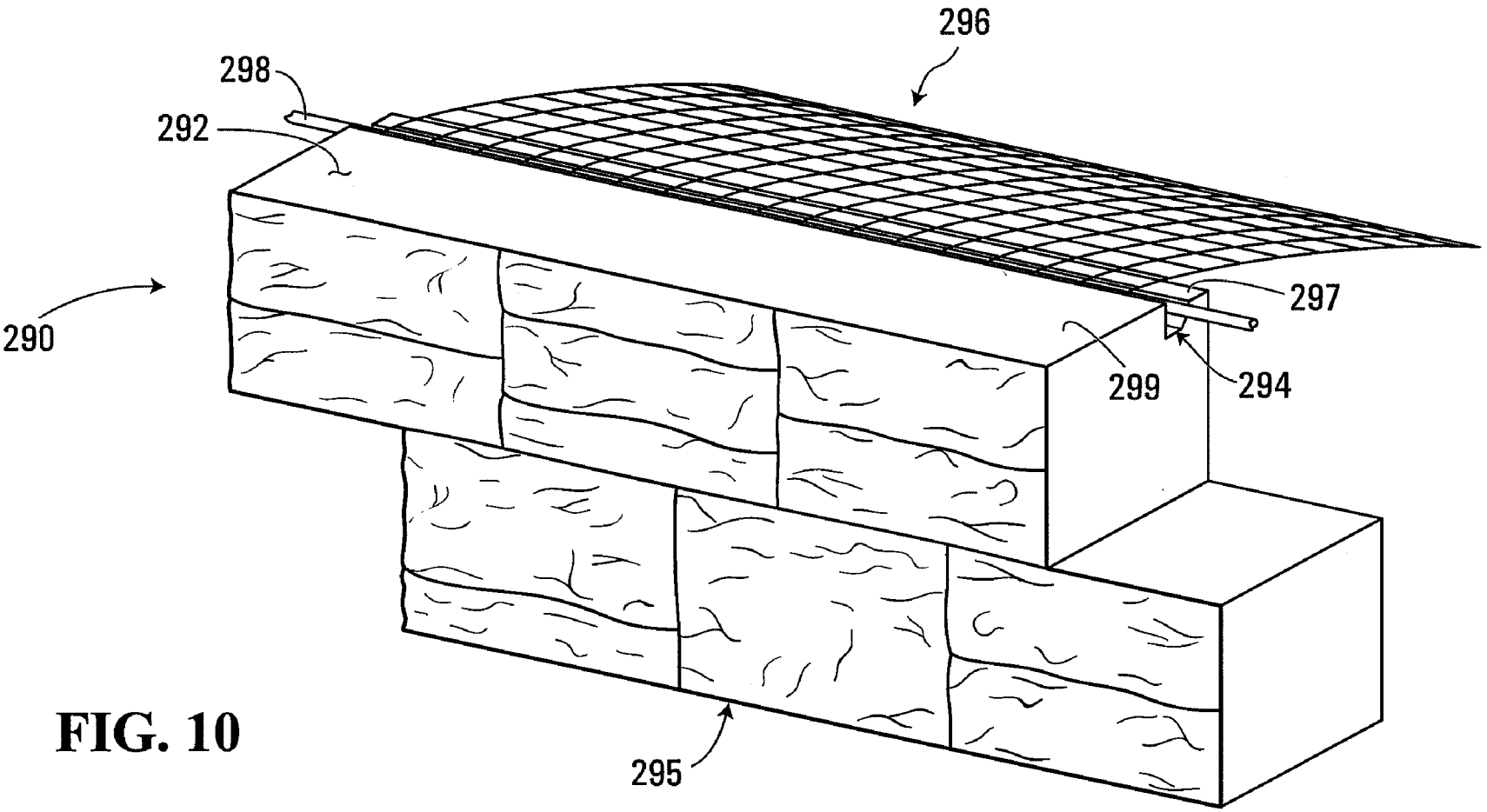
FIG. 10 is a front perspective view of a construction apparatus according to a further alternative embodiment of the invention.

Referring to FIG. 10, a construction apparatus in accordance with a further embodiment of the invention is shown generally at 290. This apparatus may be referred to as an "engineered block" or an "engineered construction apparatus". The construction apparatus 290 includes a generally flat planar top surface 292 having a recess 294 extending generally longitudinally along the top surface 292 from side to side of the body. In the illustrated embodiment, the recess 294 has a generally vertical front-side surface and a generally angled rear-side surface, but alternatively, the recess may be another shape such as trapezoidal or semi-circular in cross section, for example. The recess 294 can hold a stabilizer 296 in order to impede toppling of the construction apparatus 290 when the construction apparatus is resting on its bottom 295. A known material suitable for use as the stabilizer 296 includes Geogrid available from Nilex Inc. of Edmonton, Alberta, Canada. Another known suitable material for use as the stabilizer 296 is SRW™ Geogrid by SRW Products of Princeton, Minn. In the illustrated example, the stabilizer 296 includes a polyethylene web having a plurality of meshes. A rod 298 formed from galvanized steel, for example, may be woven through the meshes and placed in the recess 294. Where a rod 298 is woven through the meshes of the stabilizer 296, the stabilizer is preferably first folded back on itself with a minimum four-inch overlap, and the rod is preferably woven through the "doubled over" mesh. It will be appreciated that the stabilizer 296 may alternatively include an integrally formed thicker portion operable to be received in the recess 294, which obviates the need for the separate rod 298.

When one or more additional construction apparatuses (not shown) are positioned on the top surface 292 of the construction apparatus 290, the stabilizer 296 is held in the recess 294 by the weight of the construction apparatuses positioned on the top surface 292.

Preferably, a rear portion 297 of the top surface 292 is generally in a first plane (not shown) spaced apart from the bottom 295, and a front portion 299 of the top surface is generally in a second plane (not shown) spaced apart about 0.125 inches more than the first plane away from the bottom 295. Thus, when one or more additional construction apparatuses (not shown) are positioned on the top surface 292 of the construction apparatus 290, one or more respective bottom surfaces of the one or more additional construction apparatuses will rest primarily on the front portion 299, and the rear portion 297 and the one or more bottom surfaces of the one or more additional construction apparatuses above define an opening between the construction apparatuses for the stabilizer 296 to pass therethrough such that the stabilizer 296 is generally in the second plane of the front portion 299 of the top surface 292.

The stabilizer 296 preferably extends rearwardly of the construction apparatus 290, as shown in FIG. 10, and is surrounded by fill material such as soil or gravel (not shown), for example, to provide stability to a wall system comprising the construction apparatus 290. The construction apparatus 290 may be referred to as a "engineered block" or an "engineered construction apparatus", and advantageously wall systems may be constructed having heights that would otherwise be unacceptably unstable without the additional stability provided by the stabilizer 296.

It has been found that a recess, such as the recess 294, can hold a stabilizer 296 held with a rod 298 even when a tension equivalent to approximately 2,300 pounds is applied to the stabilizer 296.

Figure 11:
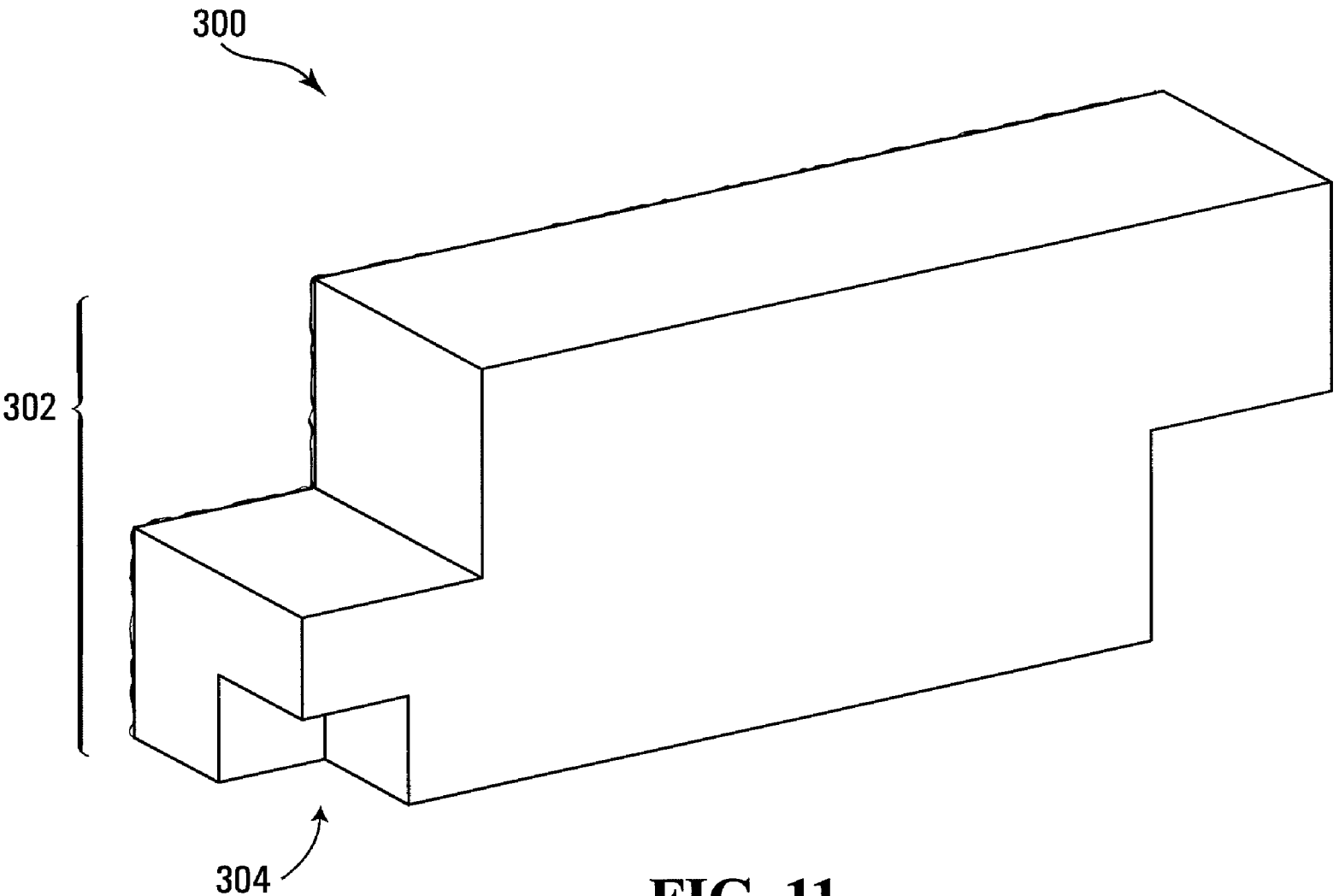
FIG. 11 is a rear perspective view of a construction apparatus according to a further alternative embodiment of the invention.

Referring to FIG. 11, a construction apparatus according to a further embodiment of the invention is shown generally at 300. In this embodiment, the construction apparatus 300 has a first side 302 having a first handle which, in this embodiment, is provided by a recess 304 in the first side.

Figure 12:
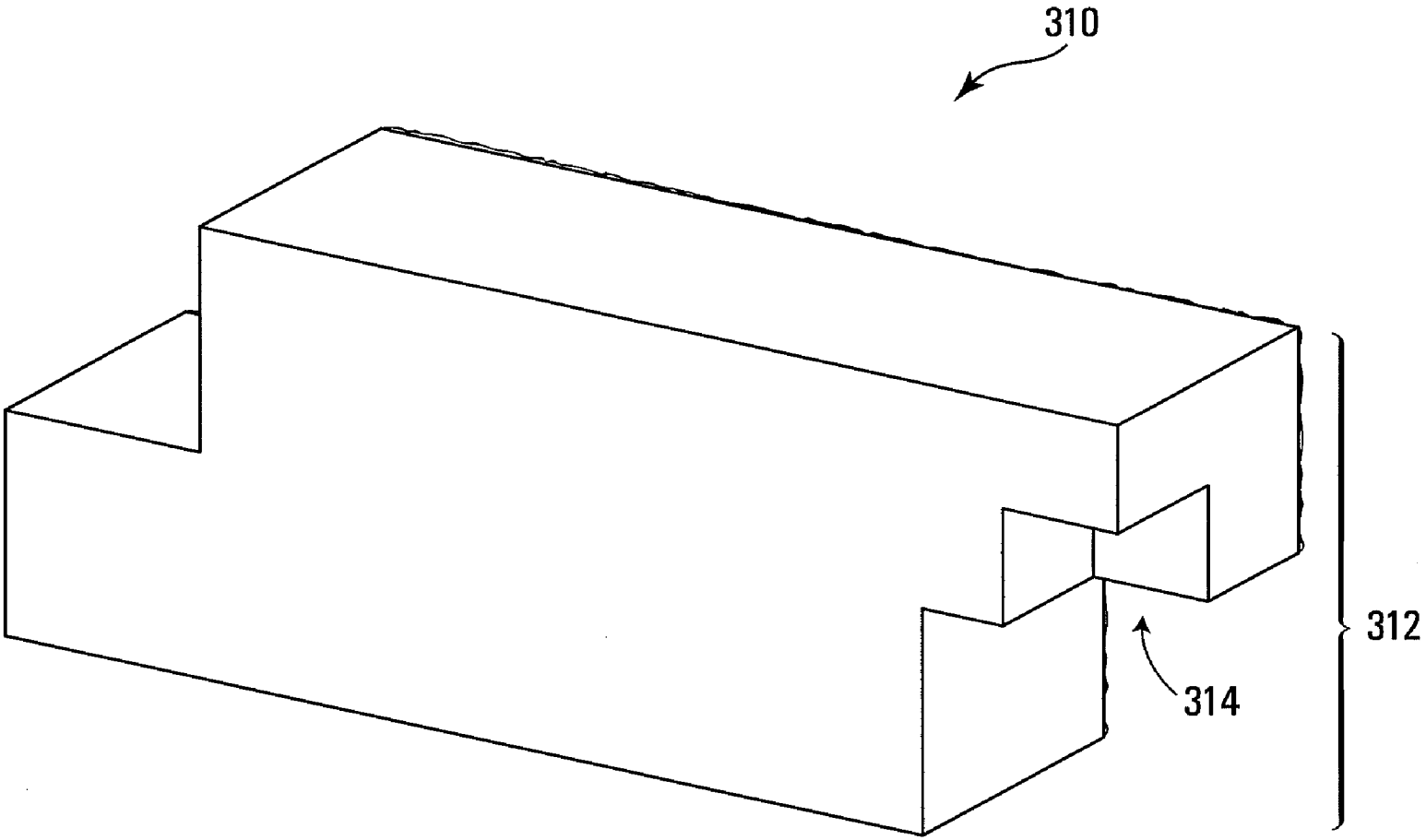
FIG. 12 is a rear perspective view of a construction apparatus according to a further alternative embodiment of the invention.

Referring to FIG. 12, a construction apparatus according to a further embodiment of the invention is shown generally at 310. The construction apparatus 310 may include the first handle (although it is not necessary and not shown) described in connection with FIG. 11 and has a second side 312 having a second handle which, in this embodiment, is provided by a recess 314 in the second side 312. Advantageously, the first and second handles (304) and 314 assist with assembly of a wall system having the construction apparatuses 300 and 310 by permitting a person to hold the construction apparatuses by the handle or handles and place the apparatus on a top surface of another apparatus without pinching fingers.

Figure 13:
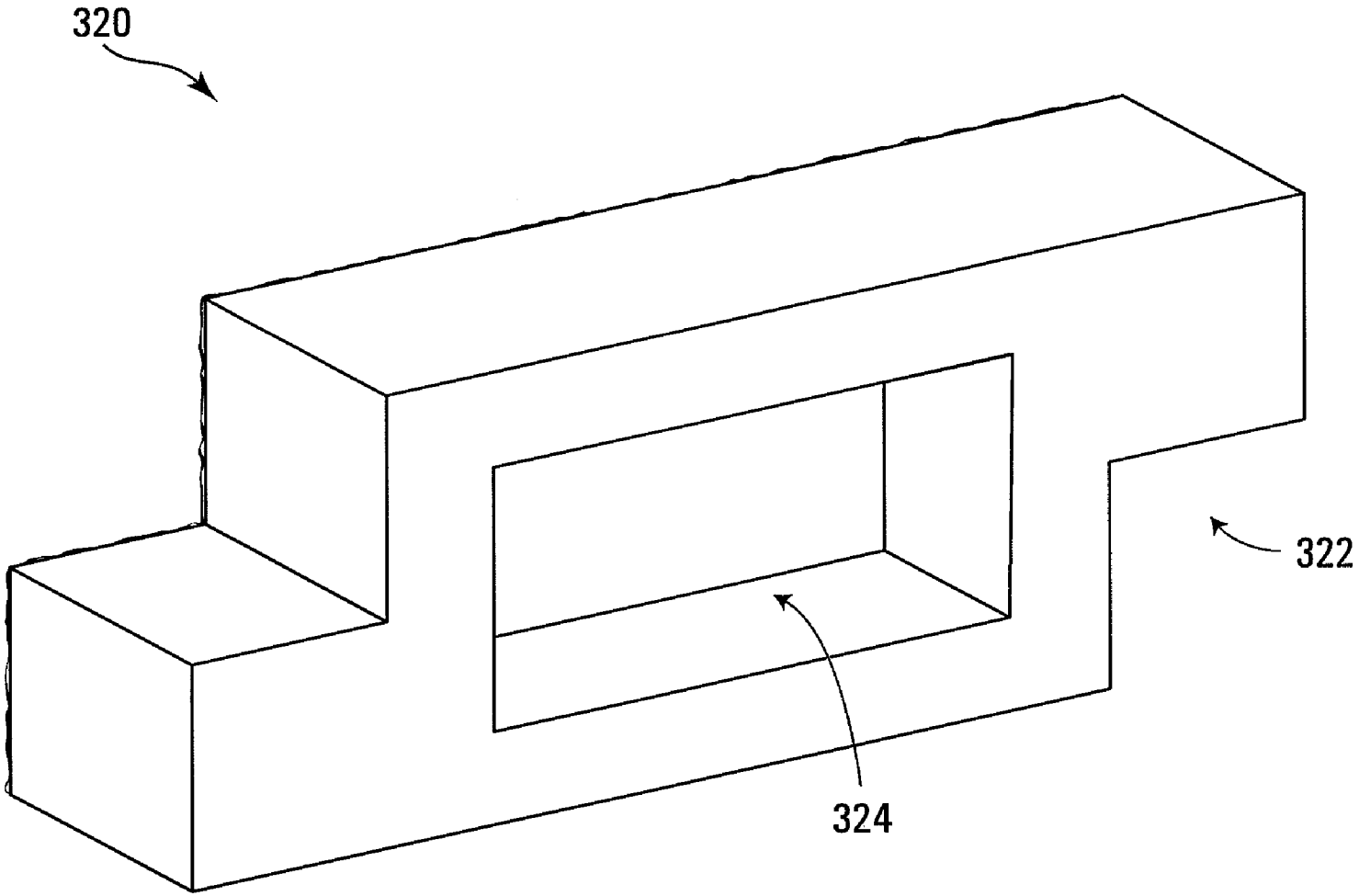
FIG. 13 is a rear perspective view of a construction apparatus according to a further alternative embodiment of the invention.

Referring to FIG. 13, a construction apparatus according to a further embodiment of the invention is shown generally at 320. The construction apparatus 320 has a rear side 322, the rear side having a recess 324. Advantageously, the recess 324 reduces the mass of the construction apparatus 320, thereby facilitating assembly of a wall system comprising construction apparatuses 320 and potentially reducing freight costs. When fill is placed behind the apparatus, the fill enters the recess 324 and provides an apparent increase to the effective mass of the construction apparatus.

Figure 14:
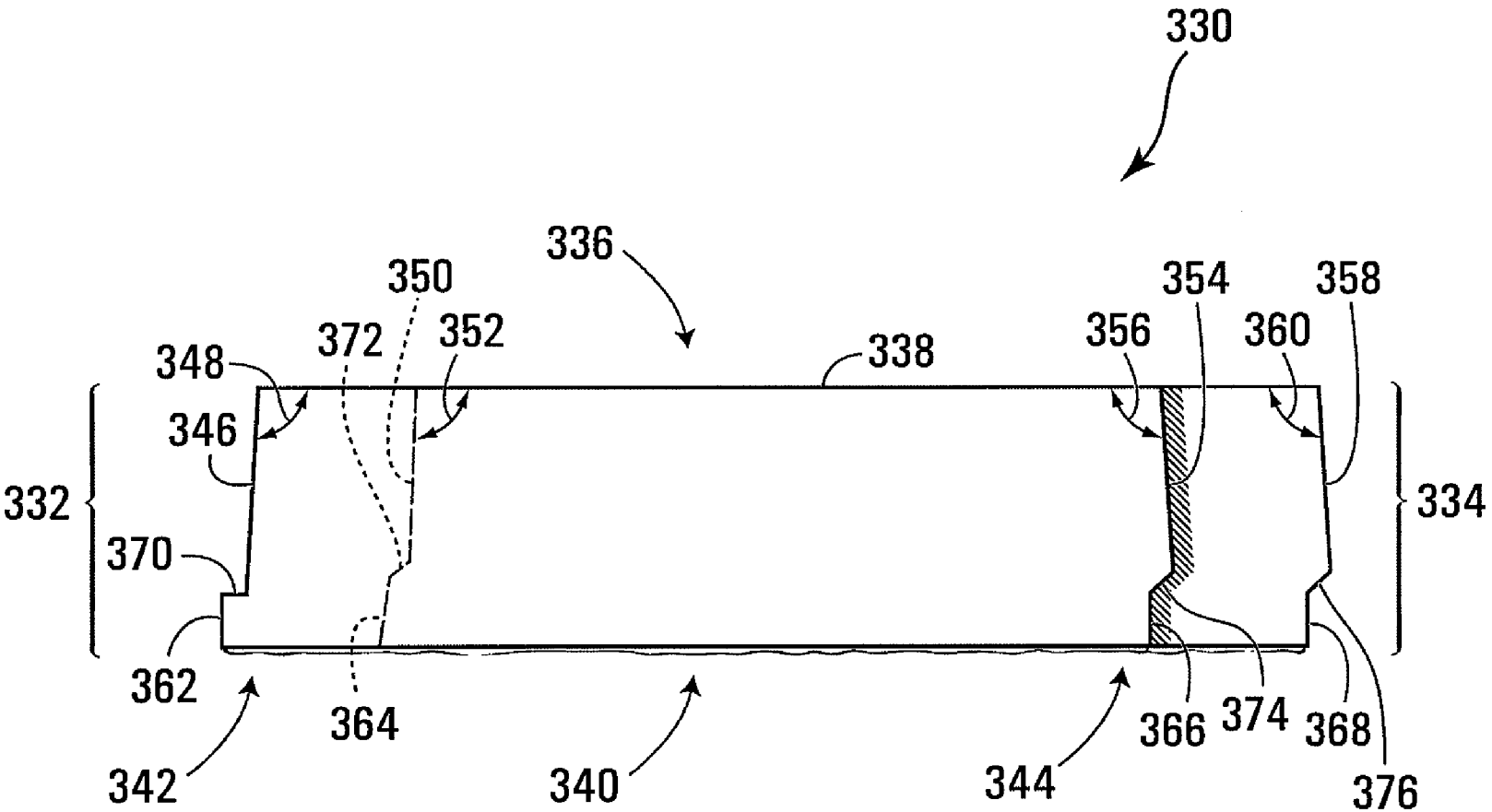
FIG. 14 is a top plan view of a construction apparatus according to a further alternative embodiment of the invention.

Referring to FIG. 14, a construction apparatus according to a further embodiment of the invention is shown generally at 330. The construction apparatus 330 has first and second opposite sides 332 and 334 respectively, a rear shown generally at 336 having a generally flat planar rear surface 338, and a front shown generally at 340 having a first front side portion shown generally at 342 disposed adjacent the first side 332 and a second front side portion shown generally at 344 disposed adjacent the second side 334. The first side 332 has a first generally planar rear side surface 346 extending at an obtuse angle 348 to the generally flat planar rear surface 338, and a second generally planar rear side surface 350 extending at an obtuse angle 352 to the generally flat planar rear surface 338. Also, the second side 334 has a third generally planar rear side surface 354 extending at an obtuse angle 356 from the generally flat planar rear surface 338, and a fourth generally planar rear side surface 358 extending at an obtuse angle 360 to the generally flat planar rear surface 338.

Still referring to FIG. 14, the first side 332 also has a first generally flat planar front side surface 362 and a second generally flat planar front side surface 364, both extending generally perpendicularly to the first front side portion 342. Also, the second side 334 has a third generally flat planar front side surface 366 and a fourth generally flat planar front side surface 368, both extending generally perpendicularly to the second front side portion 344. Furthermore, the construction apparatus 330 includes a first transition surface 370 extending between the first generally planar rear side surface 346 and the first generally flat planar front side surface 362, a second transition surface 372 extending between the second generally planar rear side surface 350 and the second generally flat planar front side surface 364, a third transition surface 374 extending between the third generally planar rear side surface 354 and the third generally flat planar front side surface 366, and a fourth transition surface 376 extending between the fourth generally planar rear side surface 358 and the fourth generally flat planar front side surface 368.

When construction apparatuses having the side surfaces shown in FIG. 14 are positioned adjacent each other such that generally complementary sides of the construction apparatuses are engaged with each other, the side surfaces illustrated in FIG. 14 advantageously prevent passage of material such as soil through the joint between the construction apparatuses, thereby improving the general appearance of a wall system comprising the construction apparatuses described herein.

Figure 36:
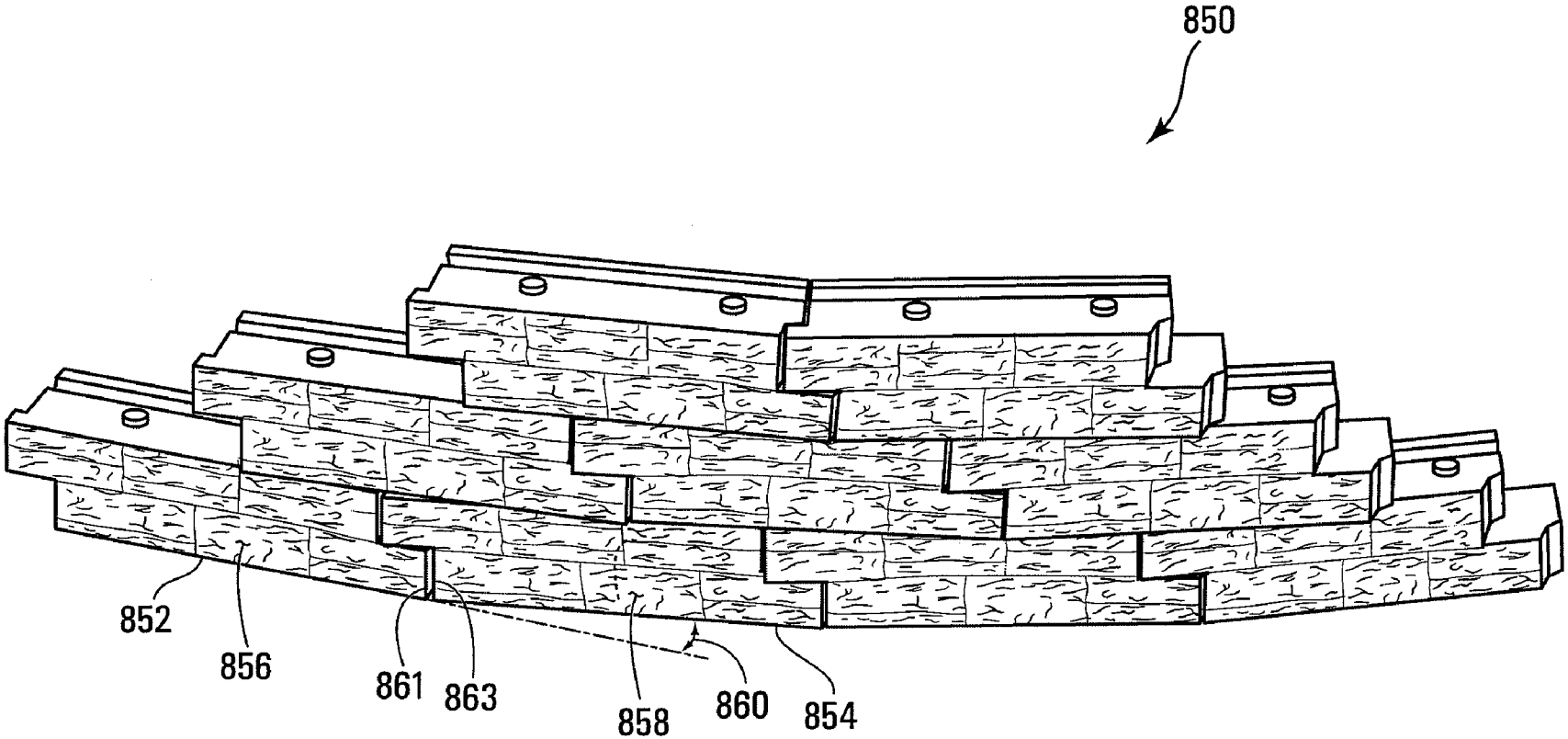
FIG. 36 is a front perspective view of a wall system according to another embodiment of the invention.

Furthermore, it has been found that construction apparatuses having the end surfaces shown generally in FIG. 14 may be positioned adjacent each other with generally complementary ends engaged with each other but with longitudinal axes of the apparatuses at an angle to form a curved wall instead of collinear as with a straight wall. The construction apparatuses may be positioned to have approximately a 10 degree angle to each other without causing noticeable gaps at the joints of the construction apparatuses, advantageously providing an attractive wall system having a curve. For example, referring to FIG. 36, a wall system according to one embodiment of the invention is shown generally at 850. The wall system 850 includes a plurality of construction apparatuses, such as first and second construction apparatuses 852 and 854 respectively. The construction apparatuses 852 and 854 have front surfaces 856 and 858 respectively, which front surfaces are at a relative angle 860, which may be as high as about 10 degrees without creating an appearance of gaps between edges such as edges 861 and 863. It has been found that "full blocks" having an overall length of approximately 28 inches, such as the construction apparatus 198 described above with reference to FIGS. 7 and 8, can be used to form a wall that maintains a continuous uniform appearance while curved with a diameter of approximately 20 to 22 feet, whereas "half blocks" such as the construction apparatus 198 illustrated in FIGS. 30 and 31 can be used to form a wall that maintains a continuous, uniform appearance while curved with approximately a 12-foot diameter.

Figure 15:
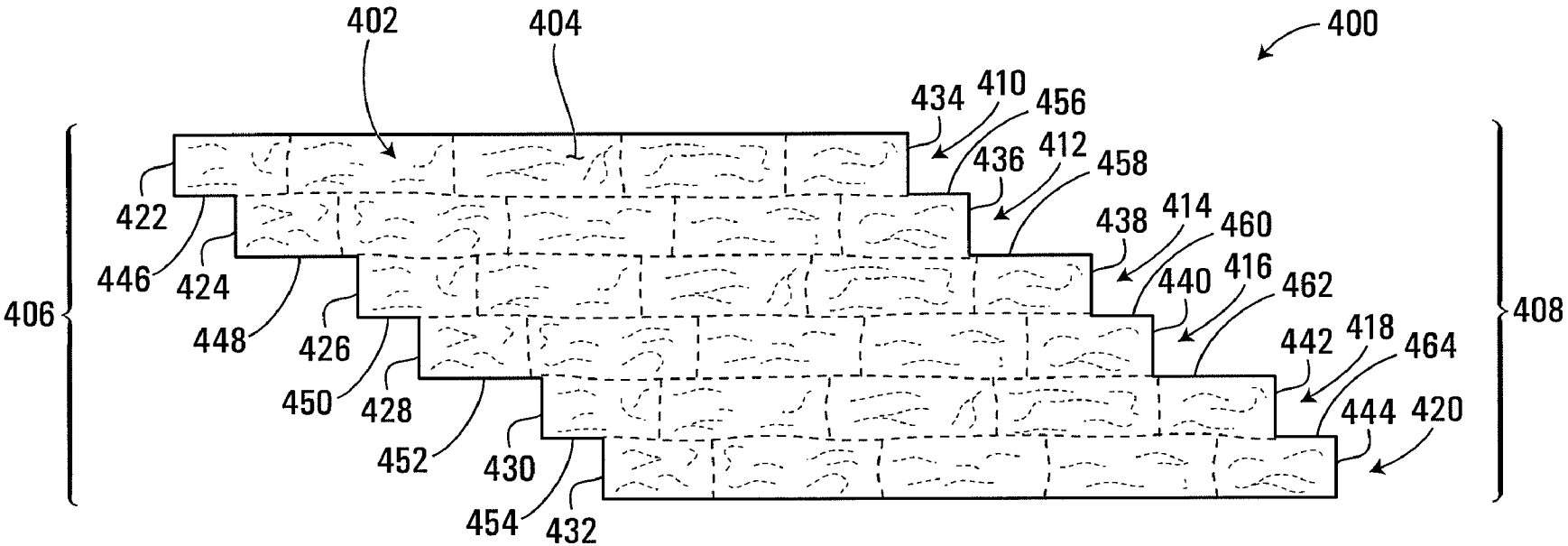
FIG. 15 is a front plan view of a construction apparatus according to a further alternative embodiment of the invention.

Referring to FIG. 15, a construction apparatus according to a further embodiment of the invention is shown generally at 400. The construction apparatus 400 has a front shown generally at 402 having a front surface 404, and first and second opposite sides 406 and 408 respectively. The front surface 404 has a plurality of block images configured to generally depict six courses of blocks 410, 412, 414, 416, 418, and 420, which each have a common course width which in this embodiment is about 4 inches (0.1 m). The first side 406 has six rises 422, 424, 426, 428, 430, and 432, and the second side 408 also has six rises 434, 436, 438, 440, 442, and 444, all of which are equal to the common course width. The first side 406 also includes five runs 446, 448, 450, and 454, and the second side 408 also includes five runs 456, 458, 460, 462, and 464. In the illustrated embodiment, the runs 446, 450, 454, 456, 460, and 464 are generally equal to the common course width, and the runs 448, 452, 458, and 462 are generally equal to twice the common course width.

In the illustrated embodiment, the common course width is approximately four inches, as in the embodiments illustrated in FIGS. 2 and 9, for example. Therefore, the construction apparatus 400 is sized to be used in a wall system comprising construction apparatuses having varying shapes and configurations including the shapes and configurations illustrated in FIGS. 2 and 9, for example. In particular, referring to the example illustrated in FIG. 9, the alternating step run sizes illustrated in the embodiment shown in FIG. 15 correspond to the effective step sizes provided in the system illustrated in the example of FIG. 9. For example, the runs and rises 448, 426, 450, 428, 452, 430, 454, and 432 in FIG. 15 may abut surfaces 466, 468, 470, 472, 474, 476, 478, and 480 respectively in the embodiment shown in FIG. 9.

Referring to the embodiments shown in FIGS. 9 and 15, it has been found that alternating the lengths of step runs may desirably assist with concealing the joints between adjacent construction apparatuses, because any lines defined by such joints appear among the mass of lines formed by adjacent block images in each construction apparatus. This makes it difficult for the eye to discern construction apparatus joints from block image joints, giving the wall a continuous appearance such as a dry stacked wall.

Figure 16:
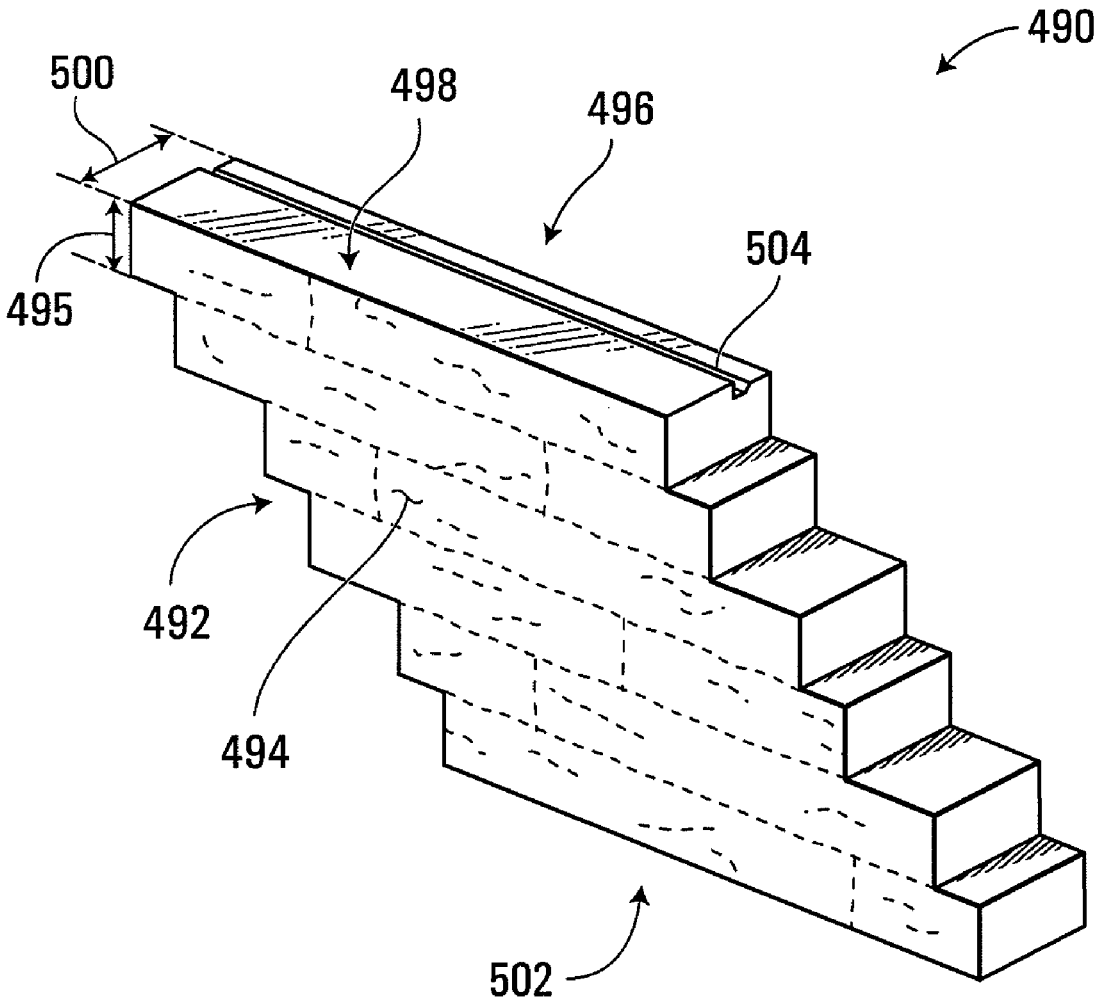
FIG. 16 is a perspective view of a construction apparatus according to a further alternative embodiment of the invention.

Referring to FIG. 16, an engineered construction apparatus in accordance with a further embodiment of the invention is shown generally at 490. The construction apparatus 490 has a front shown generally at 492 having a front surface 494 having a plurality of block images configured to generally depict six courses of blocks having a common course width 495, in accordance with the configuration shown in FIG. 15. The construction apparatus also has a rear 496 and a top 498, the top having a thickness 500 generally from the front 492 to the rear 496. In the embodiment illustrated in FIG. 16, the thickness 500 is approximately 1.5 times the common course width 495, although the thickness 500 may range from approximately 1.5 times the common course width to approximately 2.0 times the common course width. Because the thickness 500 is small relative to an overall height of the construction apparatus 490, the top 498 of the construction apparatus 490 preferably has a recess 504 extending longitudinally from end to end of the top 498, for holding a stabilizer (not shown) such as Geogrid, for impeding toppling of the construction apparatus 490 when the construction apparatus 490 is resting on its bottom 502, as discussed above with reference to FIG. 10. Accordingly, the construction apparatus 490 may be referred to as a "engineered block" or "engineered construction apparatus".

Figure 17:
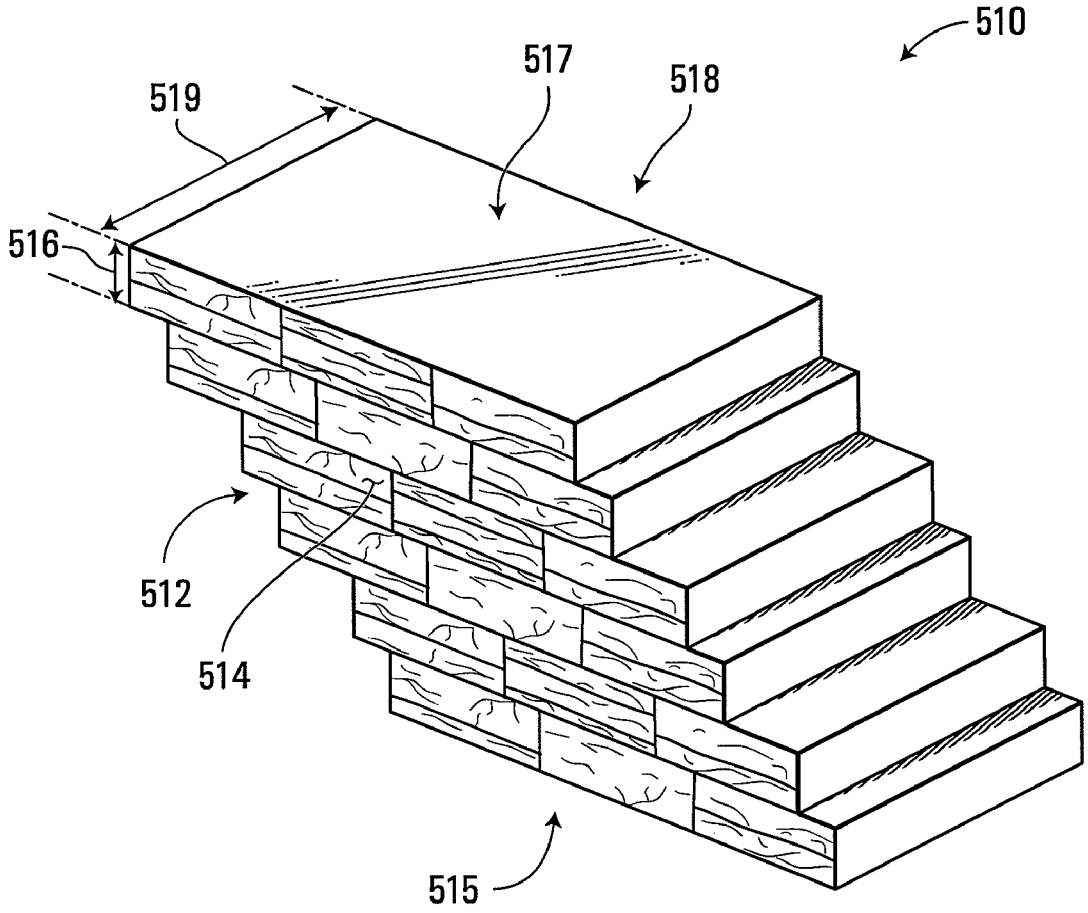
FIG. 17 is a perspective view of a construction apparatus according to a further alternative embodiment of the invention.

Referring to FIG. 17, a gravity construction apparatus according to a further embodiment of the invention is shown generally at 510. The construction apparatus 510 has a front shown generally at 512 having a front surface 514 having a plurality of block images configured to generally depict six courses of blocks having a common course width 516, in accordance with the configuration shown in FIG. 15. The apparatus also has a rear 518, a bottom 515, and a top 517 having a thickness 519 generally from the front 512 to the rear 518. In the embodiment illustrated in FIG. 17, the thickness 519 is approximately 4.5 times the common course width 516, although the thickness 519 may range from approximately 3.0 times the common course width to approximately 6.0 times the common course width. It will be appreciated that the thickness 519, or the thickness 500 shown in FIG. 16, may range from about 1.5 times a common course width to about 6 times a common course width in other variations, for example. Referring back to FIG. 17, because the thickness 519 is large relative to a height of the construction apparatus 510, a recess, such as the recess 504 shown in FIG. 16, is generally not necessary, but can be included if desired. Essentially, the construction apparatus 510 is massive and relies on its own weight for stability, and therefore such apparatus may be referred to as a "gravity block" or as a "gravity construction apparatus".

Referring back to FIG. 1, it will be appreciated that the decorative construction apparatus (30 in FIG. 2, for example), the engineered construction apparatus (490 in FIG. 16, for example), and the gravity construction apparatus (510 in FIG. 17, for example) discussed above may be combined to form the wall system 10, such that complementary adjacent sides of the various construction apparatuses cooperate to form a generally unitary wall. The use of block images, a common course width and step sizes that are related to the common course width in each type of apparatus enables all three types of apparatuses to be used with each other to produce a continuous wall having the appearance of being made of dry stacked blocks of rock. The ability to use combinations of the three types of construction apparatuses described herein provides for versatility in adapting the wall to its environment. For example, a gravity construction apparatus can be used in an area where excavation behind the wall would be difficult and the engineered construction apparatus can be used for areas which can easily be excavated and perhaps which require gradual tiering. The decorative construction apparatus can also be used for tiering and for relatively low portions of the wall such as to define a flower bed, for example. The "half blocks" of the decorative type for example, can be used to form the wall around fixed objects such as a telephone pole, for example.

Figure 18:
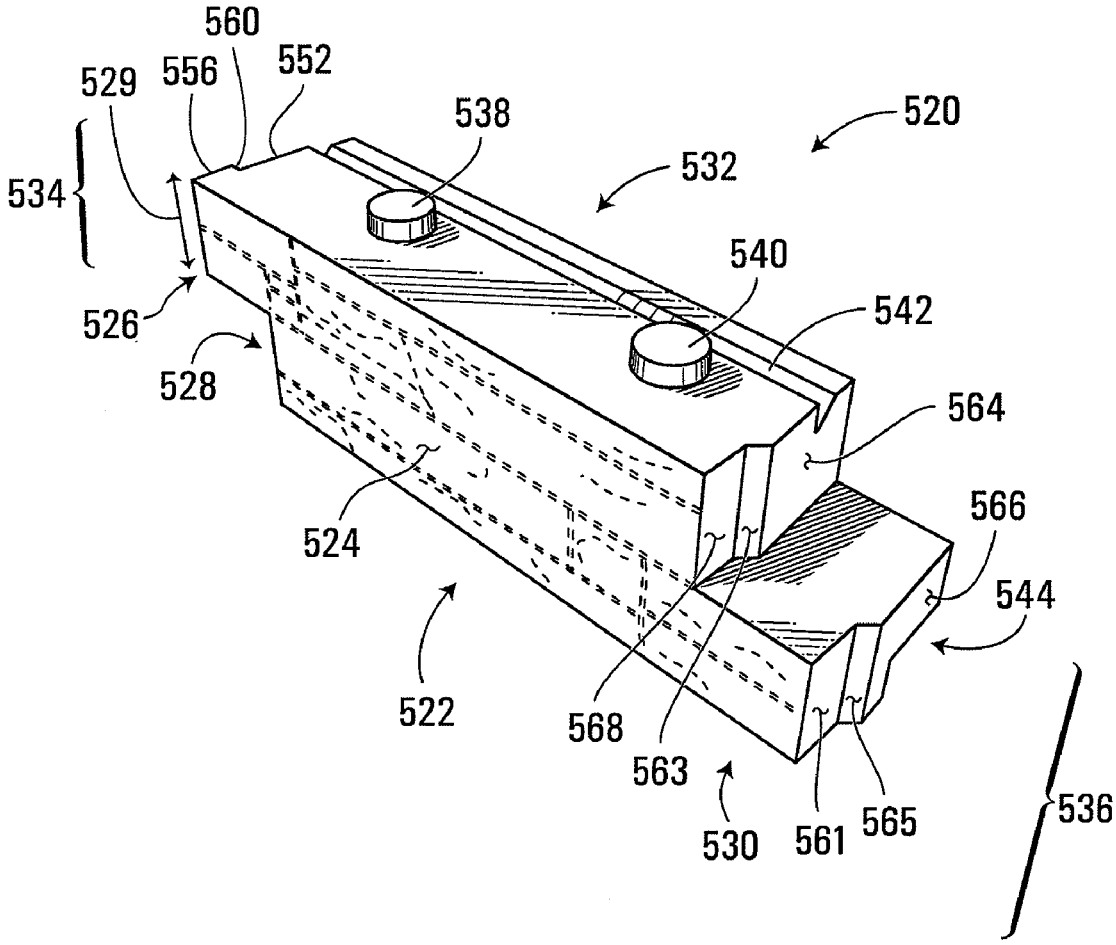
FIG. 18 is a perspective view of a construction apparatus according to a further alternative embodiment of the invention.

It will be appreciated that the features described above may be combined in construction apparatuses. For example, referring to FIG. 18, a construction apparatus according to a further embodiment of the invention is shown generally at 520. The construction apparatus 520 includes a front shown generally at 522 having a front surface 524 having a plurality of block images configured to generally depict two courses of blocks 526 and 528, each having a common course width 529. The construction apparatus 520 also has a bottom 530 and a top 532 and first and second opposite sides 534 and 536 respectively. As illustrated in FIG. 18, the construction apparatus 520 includes first and second alignment projections 538 and 540 respectively, and a recess 542 on the top 532 for holding a stabilizer as discussed above with reference to FIG. 10. The second side 536 also includes a handle 544 provided by a recess in the second side 536.

Figure 19:
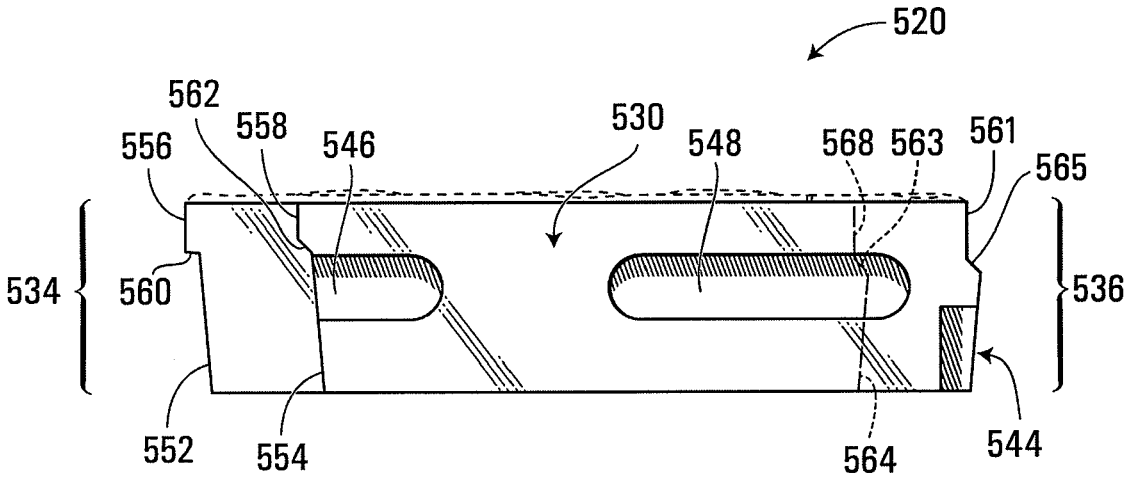
FIG. 19 is a bottom plan view of the construction apparatus of FIG. 18.

Referring to FIG. 19, the bottom 530 of the construction apparatus 520 includes first and second alignment recesses 546 and 548 respectively, and the alignment projections 538 and 540 in the alignment recesses 546 and 548 are configured as discussed above with reference to FIGS. 7 and 8.

Referring to FIGS. 18 and 19, the first side 534 of the construction apparatus 520 includes first and second generally planar rear side surfaces 552 and 554 respectively, first and second generally flat planar front side surfaces 556 and 558 respectively, and first and second transition surfaces 560 and 562. Furthermore, the second side 536 of the construction apparatus 520 includes third and fourth generally planar rear side surfaces 564 and 566 respectively, third and fourth generally flat planar front side surfaces 568 and 561, and third and fourth transition surfaces 563 and 565 respectively, as discussed above with reference to FIG. 14.

It will be appreciated that construction apparatuses in accordance with the invention are not limited to the embodiments illustrated above, but may include combinations of the features described above.

Figure 20:
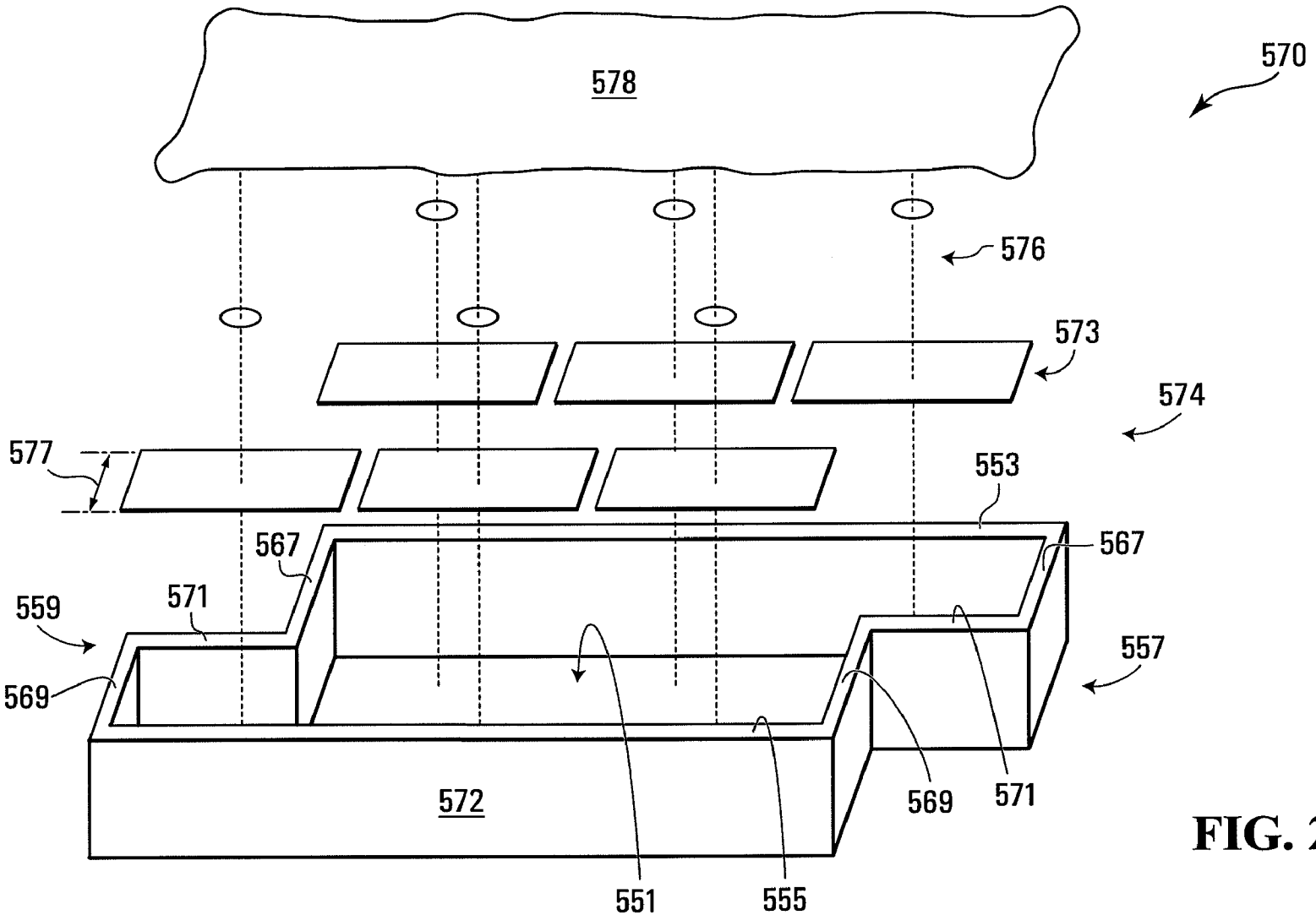
FIG. 20 is a schematic illustration of a process for making a construction apparatus according to an embodiment of another aspect of the invention.

Referring to FIG. 20, a process for making any of the construction apparatuses described above is illustrated schematically and shown generally at 570. The process 570 involves a form 572 which may also be referred to as a "mold". The form 572 has walls defining an outer perimeter of the apparatus and includes front 551, top 553, and bottom 555 walls, and first and second opposite sides 557 and 559 that have generally complementary step shapes comprising at least two rise walls 567 and 569 and at least one run wall 571 between the rises, and is thus configured to define a body having a front, a rear, a top, a bottom, and first and second opposite sides that have generally complementary step shapes comprising at least two rises and at least one run between the rises. The illustrated form 572 is in a shape to define a body for a construction apparatus such as the decorative construction apparatus 30 in FIG. 2. However, it will be appreciated that the form 572 may be in a shape to define any of the construction apparatuses disclosed herein. The process 570 involves arranging a plurality of block image templates, which are also known as form liners, shown generally at 574, on the front wall 551 of the form, although it will be appreciated that the plurality of block image templates may be separate or formed as a unitary piece comprising a plurality of block images. It has been found that urethane is a preferable material for the block image templates 574, although any material suitable for forming the moldable material discussed below may be used.

In the process 570, the plurality of block image templates 574 are arranged in the form 572 in a plurality of courses (573, for example) having respective course widths 577. Each rise wall 567 and 569 in the form 572 has a length equal to one of the course widths 577 or a sum of a plurality of the course widths, so that the form 572 is configured to define a body having first and second opposite sides that have generally complementary step shapes comprising at least two rises and at least one run between the rises, each rise being about equal to one of the course widths or to a sum of a plurality of the course widths. The block image templates 574 are configured to have image-forming surfaces complementary to the desired block images. The block images may be of hewn rocks or dry-stacked hewn rocks, for example.

Preferably, but not necessarily, the process 570 further involves placing a coloured slurry 576 on at least one of the block image templates 574. The coloured slurry 576 may include iron oxide pigments, as are known in the art, mixed with water and cement. In a preferred aspect, the coloured slurry is approximately, by volume, $\frac{1}{8}^{th}$ oxide pigment, $\frac{3}{8}^{th}$ water, and ½ cement. Other additives such as mica flakes or sand may be added, and are known in the art. It has been found that the coloured slurry must be mixed very well, preferably with a power mixing tool such as a hand mixer, and that a paint brush may preferably be used to apply the coloured slurry 576 the plurality of image templates 574. It has been found that the coloured slurry 576 should be applied to the block image templates 574 within approximately five to ten minutes of creating the coloured slurry, because a longer period of time may result in undesired evaporation of water therefrom.

After the coloured slurry 576 has been applied, if at all, the process 570 then involves placing a moldable material 578 on the block image templates 574 in the form 572. The moldable material 578 may be an uncured concrete mix of the type that is well known in the art (e.g., by volume, one part cement, four parts gravel, and one part water).

As mentioned above, the moldable material 578 may include pumice, or more preferably a less expensive material such as cellular concrete, to reduce the weight of the resulting body. Alternatively, where weight of the resulting body is less of a concern, a standard inexpensive concrete mix may be used.

In the illustrated process 570, the moldable material 578 is preferably a relatively plastic concrete mix to permit a "wet cast" of the resulting body, as is well-known in the art. A "wet cast" is preferable over dry cast methods as it facilitates a process of colouring the construction apparatuses with the coloured slurry described above.

The process 570 then involves causing the moldable material 578 to solidify in the form 572 to define a body such that a front of the body has a surface having a plurality of block images defined by the block image templates 574, and such that the block images generally depict a plurality of courses of blocks.

The moldable material 578 may have a base colour, such as grey in the case of uncured concrete mix, which becomes a base colour of the body of a construction apparatus formed from the moldable material. If the coloured slurry 576 is placed on at least one of the block image templates 574, the coloured slurry generally infuses into the moldable material 578 to colour a front of the resulting body in a colour that may be different from a base colour of the moldable material to create the random colouring normally seen in rock. In other words, the tapered spacer 582 is wedge-shaped.

Figure 21:
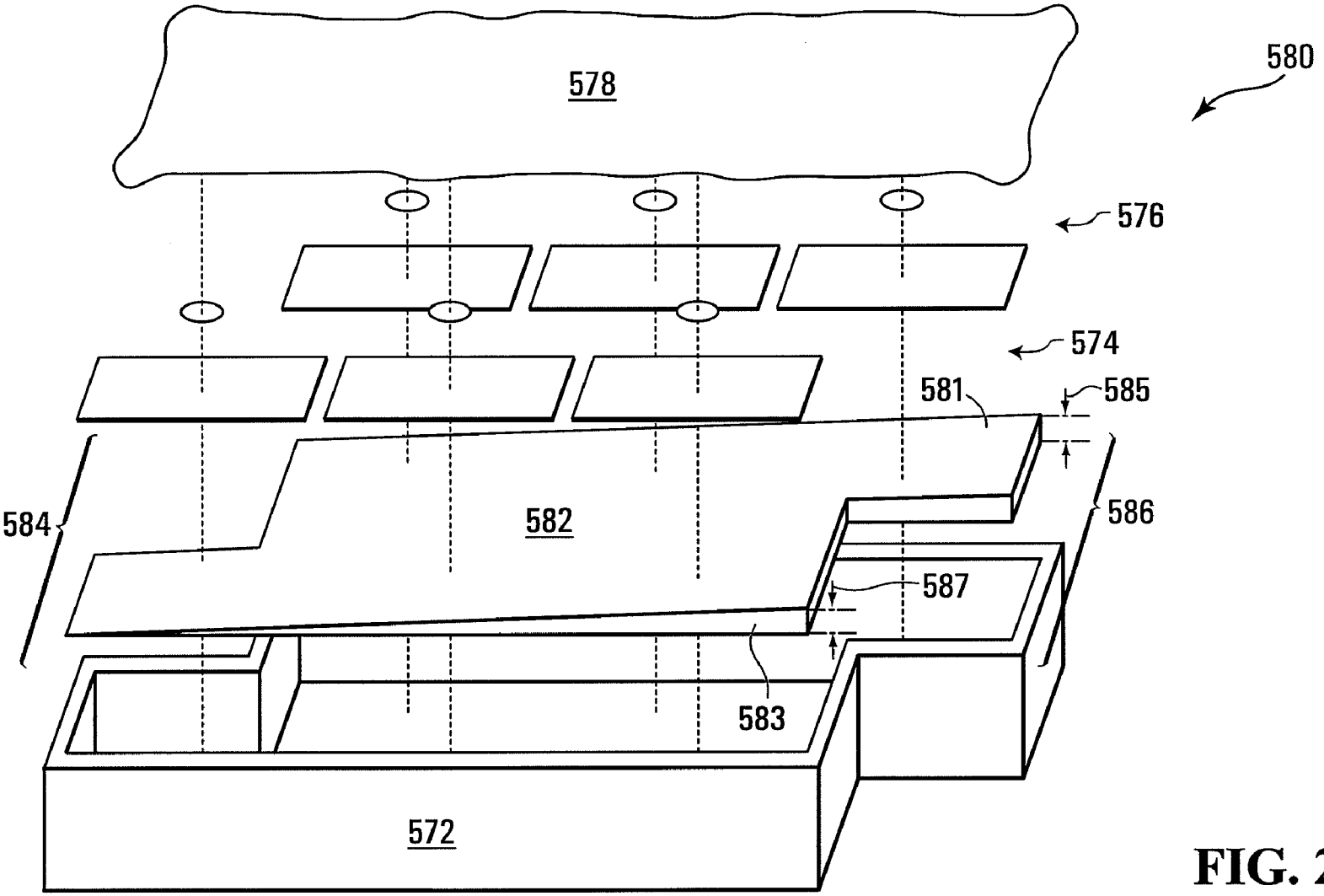
FIG. 21 is a schematic illustration of a process for making a construction apparatus according to an alternative embodiment of the invention.

Referring to FIG. 21, a variation of the process 570 is shown generally at 580. In the process 580, a tapered spacer 582 is placed in the form 572 before the plurality of block image templates 574, optional coloured slurry 576, and moldable material 578 are placed in the form 572. In this variation, the block image templates 574 are arranged on the tapered spacer 582. The tapered spacer 582 causes a front surface of the resulting body to lie generally in a plane extending at an angle to a rear surface of the body. In the example illustrated in FIG. 21, the tapered spacer 582 has a first end 584 and a second end 586, and the tapered spacer generally has a taper from a smaller thickness the first end 584 to a greater thickness at the second end 586.

Advantageously, the tapered spacer 582 may cause a first end of the body formed in the form 572 proximate to the first end 584 of the tapered spacer to be thicker than a second end of the body formed proximate to the second end 586 of the tapered spacer, so that the thinner second end of the body can be placed at a greater angle to a complementary end of a body of an adjacent construction apparatus, to create a wall having a small radius. This may be useful for the gravity-type decorative construction apparatuses which tend to be relatively large.

Alternatively, the spacer 582 may be curved in such a manner to cause the front surface of a body formed in the form 572 to be either convex or concave. Advantageously, a convex or concave front surface of the resulting body permits use of the body to construct a wall apparatus that is generally convex or concave, respectively, without creating non-uniform joints between adjacent construction apparatuses.

In yet a further alternative, the tapered spacer 582 may have a top 581 and a bottom 583, wherein the top has a greater thickness 585 than a thickness 587 of the bottom such that a top of the body formed in the form 572 is thinner than a bottom of the body formed. Advantageously, in this embodiment, the front surface of the resulting body generally has a slope of about three degrees, as discussed above with reference to FIG. 5, for example, in order to keep the size of gaps at joints between adjacent "set back" construction apparatuses to a minimum. Furthermore, it will be appreciated that the spacer 582 may be both tapered, and convex or concave, to provide for a setback and the ability to create a wall having a small radius.

Figure 22:
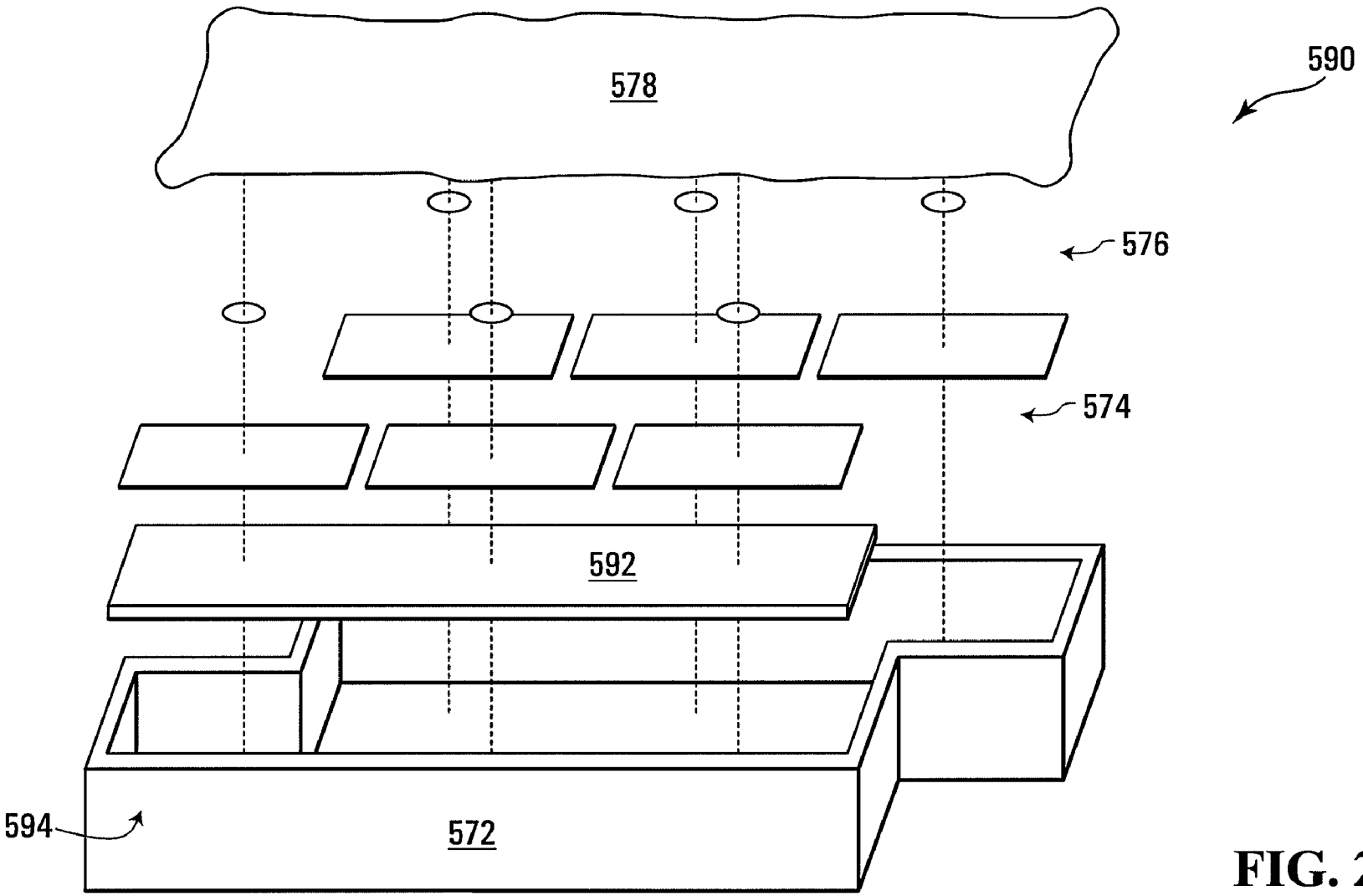
FIG. 22 is a schematic illustration of a process for making a construction apparatus according to a further alternative embodiment of the invention.

Referring to FIG. 22, a further variation of the process 570 is shown generally at 590. The process 590 involves placing at least one spacer 592 in the form 572 before placing the plurality of block image templates 574, the optional coloured slurry 576, and the moldable material 578 in the form 572. In the process 590, the at least one spacer 592 is placed in the form 572 adjacent a top-forming portion 594 of the form 572 such that a body formed in the form 572 has a top thickness (generally from a front to a rear of the body) that is less than the bottom thickness (also generally from the front to the rear) of the body. Alternatively, it will be appreciated that a plurality of spacers 592, or a tapered spacer (not shown), may be placed in the form 572 to form a body having a top thickness that is less than a bottom thickness of the body. In a further alternative, it will be appreciated that the at least one spacer 592 may be placed under at least some courses of the block image template 574, such that each course is spaced from a bottom of the form at a different distance so that the body will have a greater thickness near a bottom of the body than near the top of the body. In yet a further alternative, it will be appreciated that the process 590 may involve placing a plurality of spacers in the form 572 such that each course is associated with a respective spacer size.

Figure 23:
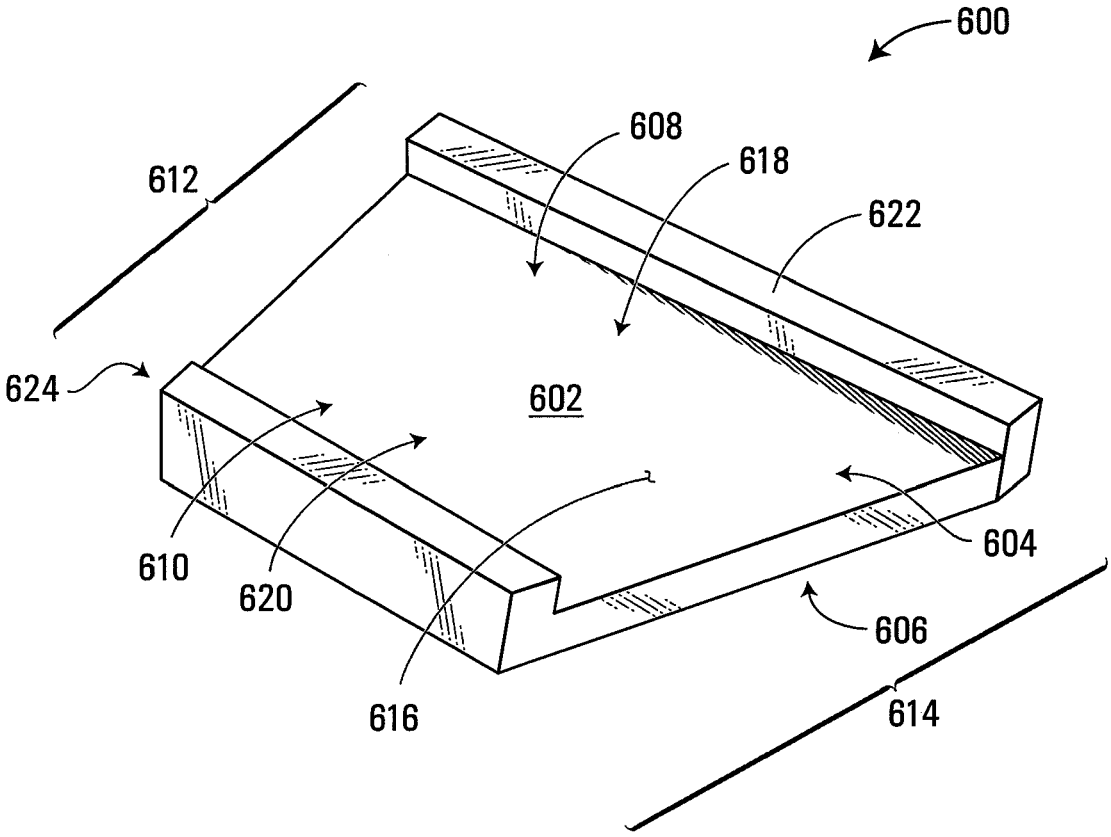
FIG. 23 is a rear perspective view of a base apparatus according to an embodiment of another aspect of the invention.

Referring to FIG. 23, a base apparatus in accordance with a further embodiment of the invention is shown generally at 600. The base apparatus 600 includes a plate shown generally at 602. The plate 602 may be formed from concrete, for example. The plate 602 has a top 604, a bottom 606, a front 608, and a rear 610, and first and second opposite sides 612 and 614 respectively. The top 604 includes a generally planar surface 616 having a front support region 618 proximate the front 608 for holding a body of one of the construction apparatuses described above, and a rear retaining region 620 proximate the rear 610 for holding utility conduits in place and/or for holding aggregate material behind the body of the construction apparatus held in the front region.

The base apparatus 600 further includes at least one front stop 622 projecting upwardly from the generally planar surface 616 of the top 604, adjacent the front 608, for stopping a construction apparatus from sliding forward on the top. The base apparatus 600 also includes at least one rear retainer 624 projecting upwardly from the generally planar surface 616 of the top 604, adjacent the rear 610, for retaining material closely adjacent a construction apparatus when a construction apparatus is installed on the front support region 618. In the example illustrated in FIG. 23, the at least one front stop 622 and the at least one rear retainer 624 extend generally respective widths of the front 608 and rear 610 of the base apparatus 600. However, it will be appreciated that alternatively, the front stop 622 and the rear retainer 624 may include a plurality of spaced apart projections, for example. Also, in the illustrated example, the first and second sides 612 and 614 respectively are wider adjacent the front 608 than adjacent the rear 610.

Figure 24:
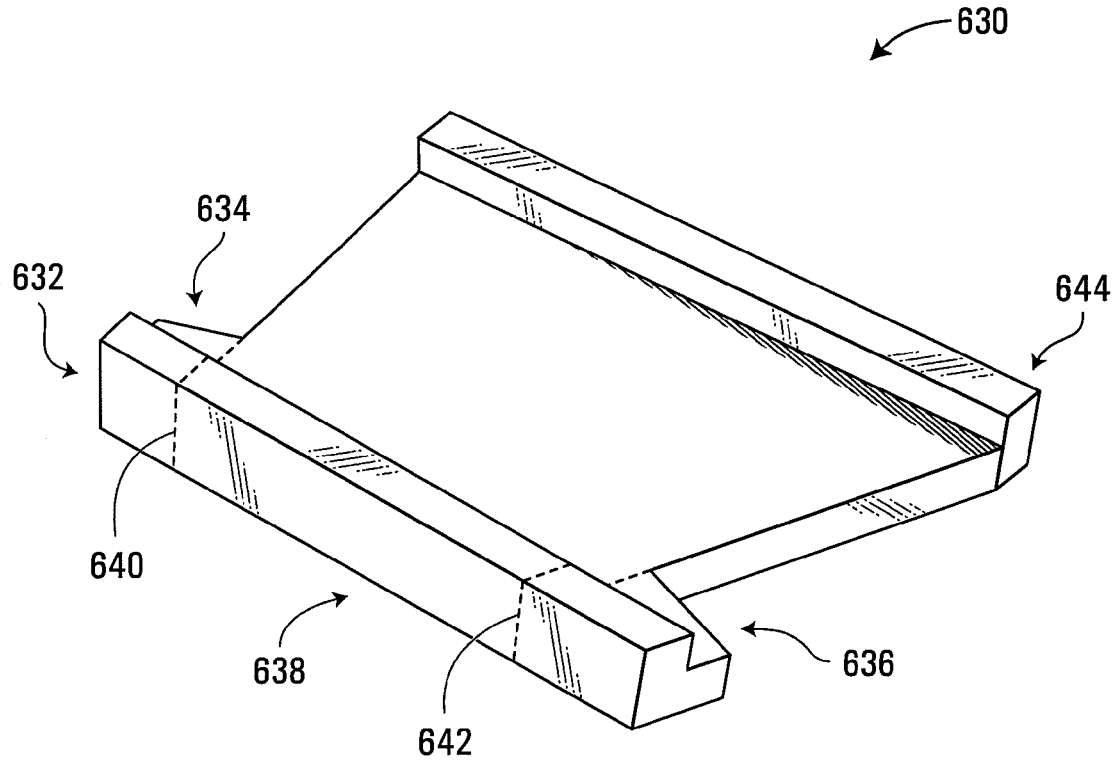
FIG. 24 is a rear perspective view of a base apparatus according to an alternative embodiment of the invention.

Referring to FIG. 24, a base apparatus in accordance with a further embodiment of the invention is shown generally at 630. The base apparatus 630 is similar to the base apparatus shown in FIG. 23 and includes a rear retainer 632 having first and second lateral projections shown generally at 634 and 636 respectively that extend laterally adjacent opposite sides of the base apparatus. The base apparatus 630 further includes a main portion shown generally at 638 extending between the first and second lateral projections 634 and 636. Preferably, but not necessarily, the rear retainer 632 includes a first frangible portion 640 connecting the first lateral projection 634 and the main portion 638, and a second frangible portion 642 connecting the second lateral projection 636 and the main portion 638. The first and second frangible portions 640 and 642 respectively may be formed by causing the cross-sectional area of the projection to be reduced, such as by scoring, for example. Advantageously, the first and second frangible portions 640 and 642 may facilitate detachment of one or both of the first and second lateral projections 634 and 636 respectively, so that adjacent base apparatuses 630 may be positioned such that front surfaces 644 of the base apparatuses are at significant angles to each other in a horizontal plane, permitting a generally curved arrangement of the base apparatuses 630 for producing a curved wall system.

Figure 25:
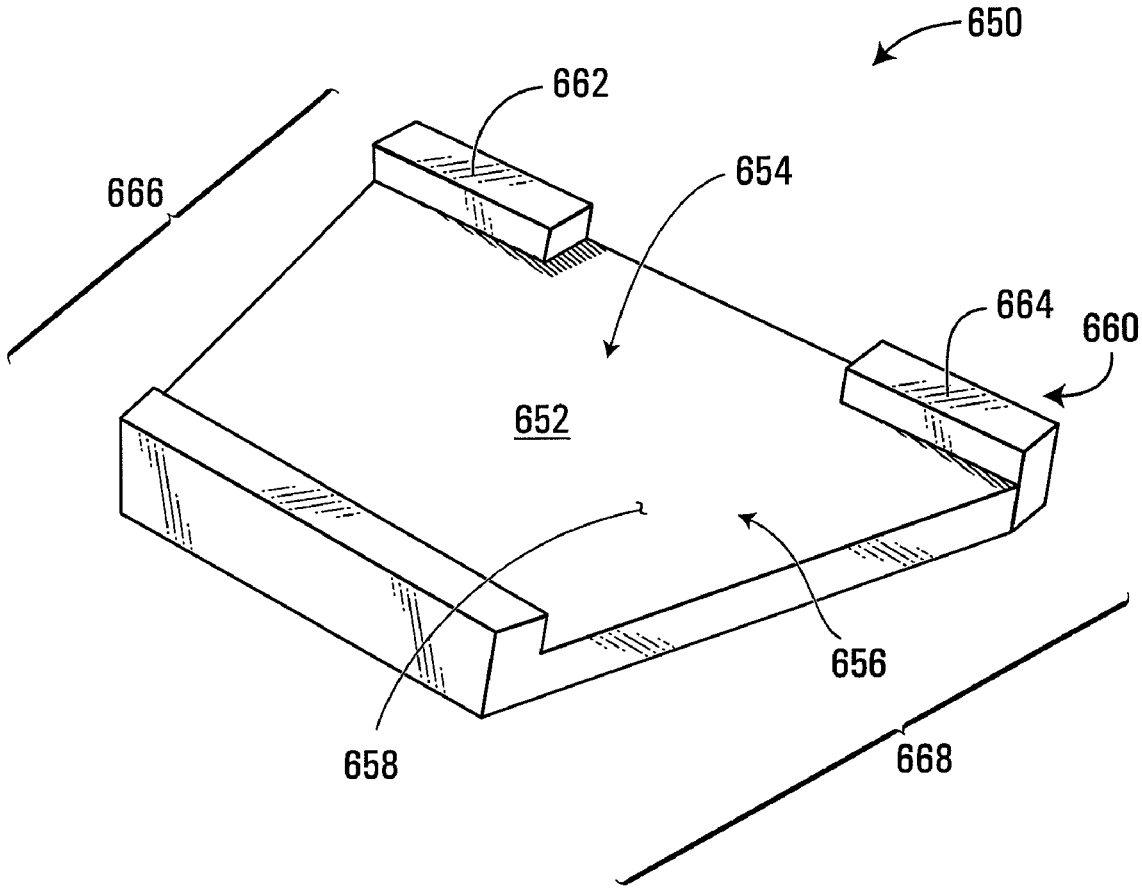
FIG. 25 is a rear perspective view of a base apparatus according to a further alternative embodiment of the invention.

Referring to FIG. 25, a base apparatus according to a further embodiment of the invention is shown generally at 650. The base apparatus 650 includes a plate 652 having a front 654 and a top 656, the top having a generally planar surface 658. The base apparatus 650 further includes at least one front stop, shown generally at 660, the at least one front stop including first and second spaced apart stops 662 and 664 projecting upwardly from the generally planar surface 658 of the top 656, adjacent the front 654. In the illustrated example, the first and second spaced apart stops 662 and 664 respectively are adjacent first and second sides 666 and 668 respectively.

Figure 26:
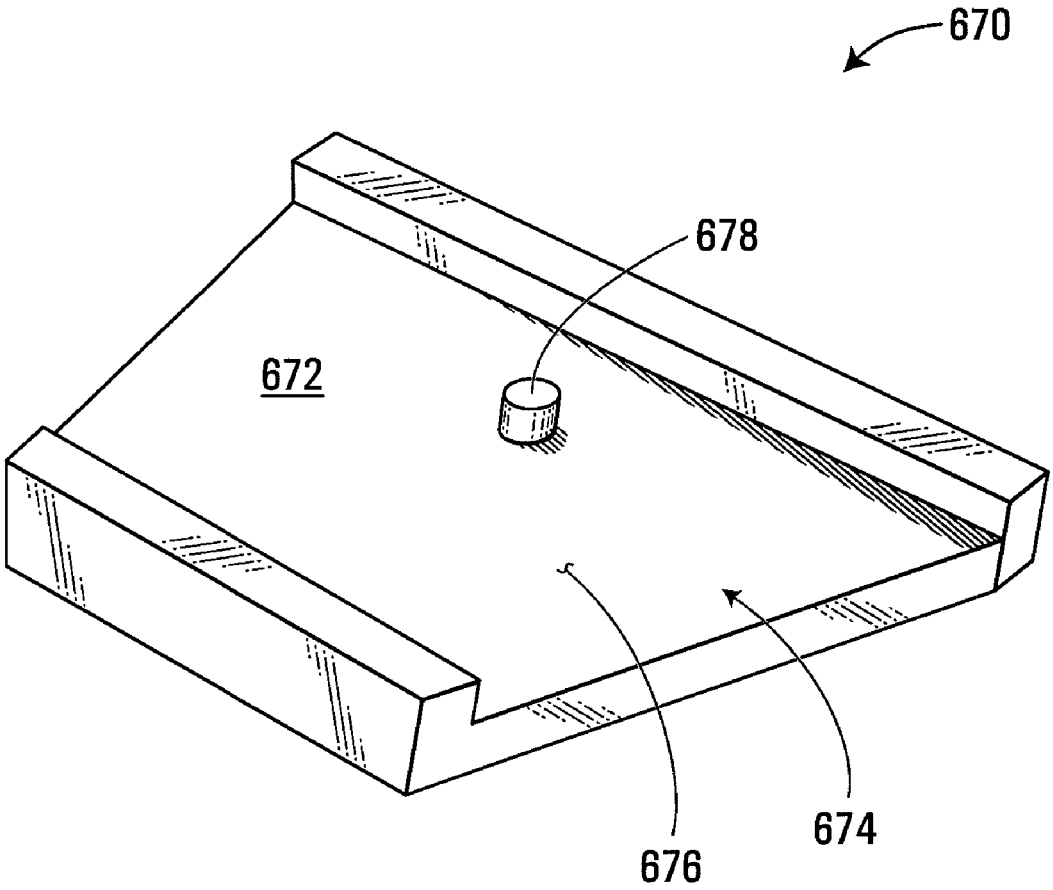
FIG. 26 is a rear perspective view of a base apparatus according to a further alternative embodiment of the invention.

Referring to FIG. 26, a base apparatus according to a further embodiment of the invention is shown generally at 670. The base apparatus 670 includes a plate 672 having a top shown generally at 674, the top having a generally planar surface 676. The base apparatus 670 further includes at least one alignment projection 678 projecting outwardly from the top 674. The alignment projection 678 in the illustrated example is configured to be received in a complementary opening in a construction apparatus, such as the alignment recess 208 or 210 illustrated in FIG. 8, for example.

It will be appreciated that the features illustrated in the base apparatuses of FIGS. 23, 24, 25, and 26 may be combined together. For example, referring to FIG. 27, a base apparatus according to a further embodiment of the invention is shown generally at 680. The base apparatus 680 includes a concrete plate 682 having a top shown generally at 684, the top having a generally planar surface 686. The plate 682 further includes a front shown generally at 688 and a rear shown generally at 690. The base apparatus 680 further includes at least one front stop shown generally at 692, the at least one stop including first and second spaced apart stops 694 and 696 projecting upwardly from the generally planar surface 686 of the top 684, adjacent the front 688. The first stop 694 is located adjacent a first side 698 of the base apparatus, and the second stop 696 is located adjacent a second side 700 of the base apparatus. The base apparatus 680 further includes at least one alignment projection 702 extending outwardly from the generally planar surface 686 of the top 684. The alignment projection 702 is configured to be received in a generally complementary opening in a construction apparatus, such as the alignment recess 208 or 210 illustrated in FIG. 8, for example.

The base apparatus 680 further includes at least one rear retainer shown generally at 704. The rear retainer 704 projects upwardly from the generally planar surface 686 of the top 684, adjacent a rear 706 of the plate 682. The first and second sides 698 and 700 respectively are wider adjacent the front 688 than adjacent the rear 706, except that the rear retainer 704 includes first and second lateral projections, shown generally at 708 and 710 respectively, separated from a main portion 712 of the rear retainer by first and second frangible portions 714 and 716 respectively. The plate 682 further includes a front support region shown generally at 718 proximate the front 688 for supporting the body of a construction apparatus of the type described above, and a rear retainer region shown generally at 720 for retaining utility conduits and aggregate material placed behind the body held in the front support region. However, it will be appreciated that a base apparatus may alternatively include any combination of the features shown in FIGS. 23, 24, 25, and 26.

A process of constructing a base apparatus, such as the base apparatuses illustrated in FIGS. 23, 24, 25, 26, and 27, preferably involves a process known as "dry cast", as is well-known in the art and distinct from the "wet cast" process mentioned above. A "dry cast" process may involve placing a stiff concrete mix into a form configured to form the base apparatus, and pressing and compacting the concrete mix in the form. A "dry cast" process is preferred for a base apparatus because it may be a generally more inexpensive process than a "wet cast" process. The wet cast process can, however, be used instead of the dry cast process but it may be more time consuming.

In either the dry cast process or the wet cast process, the base apparatus preferably includes reinforcing material such as ½" re-bar and/or 8 gauge steel wire mesh, to provide tensile strength to the concrete used to form the base apparatus, and to maintain functionality of the base apparatus even if portions of the concrete of base apparatus have cracked.

Figure 27:
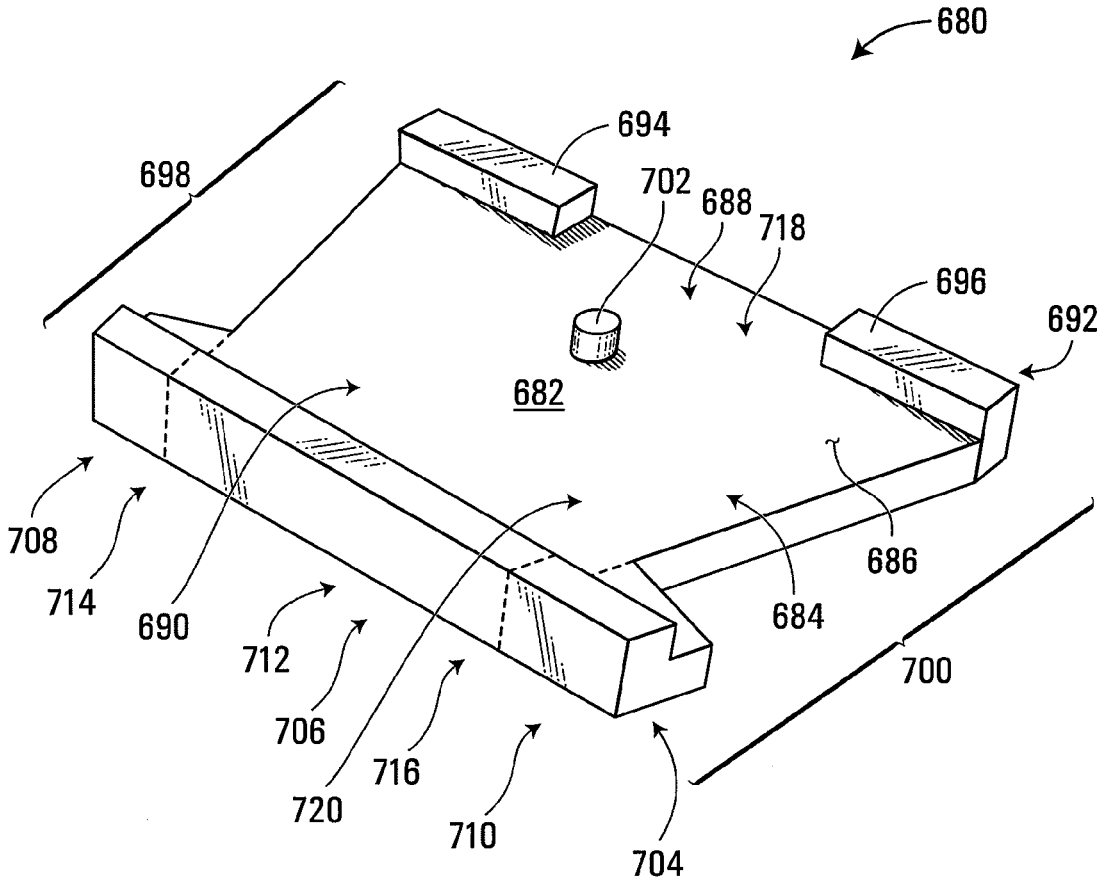
FIG. 27 is a rear perspective view of a base apparatus according to a further alternative embodiment of the invention.

Still referring to FIG. 27, the front support region 718 may support a construction apparatus (not shown) such as the construction apparatuses disclosed herein, for example, and the rear retaining region 720 may support fill material (not shown) adjacent a rear of the construction apparatus, which material may include gravel or soil, for example. Advantageously, and particularly when one or more construction apparatuses are positioned on the front support region 718, the weight of the fill material supported by the rear retaining region 720 counteracts the weight of the construction apparatus on the front support portion and thereby reduces the chances of toppling of a wall system supported by the base apparatus 680 that can otherwise occur due to outward pressure naturally created by material adjacent the rear of the construction apparatus.

Figure 28:
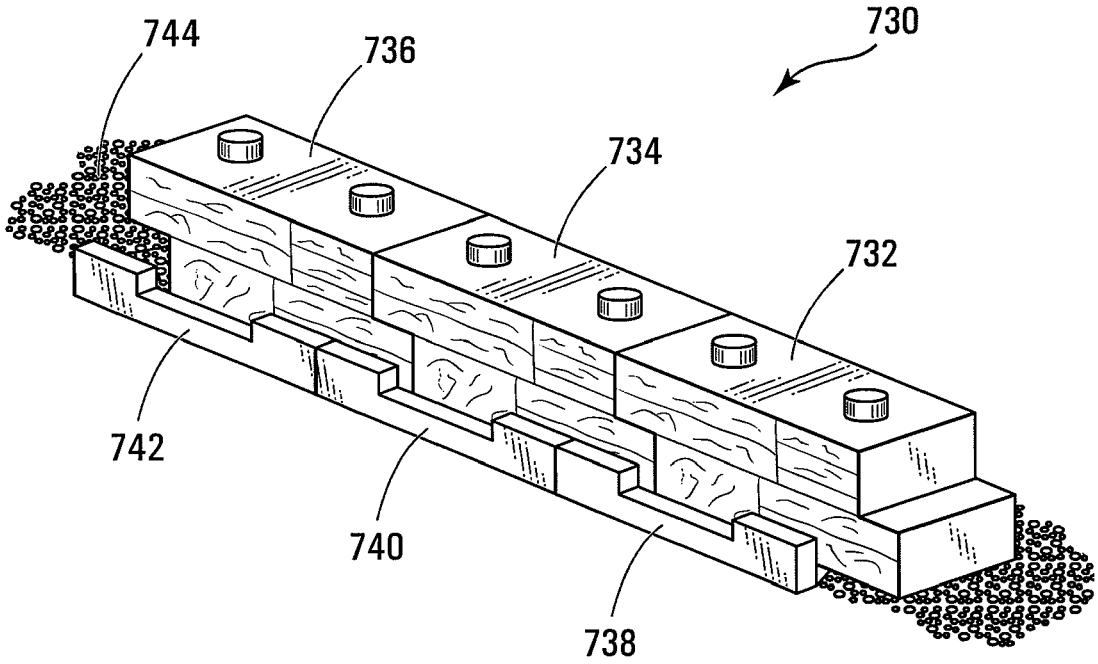
FIG. 28 is a front perspective view of a wall system according to another embodiment of the invention.

Referring to FIG. 28, a wall system in accordance with a further embodiment of the invention is shown generally at 730. The wall system 730 includes three construction apparatuses 732, 734, and 736, supported on three base apparatuses 738, 740 and 742. The construction apparatuses 732, 734 and 736 may be of the type illustrated in FIGS. 7 and 8 for example, and the base apparatuses 738, 740 and 742 may be of the type illustrated at 680 in FIG. 27, for example. In the wall system 730, alignment projections (not shown) of the base apparatuses 738, 740, and 742 are received in alignment recesses (not shown) of the construction apparatuses 732, 734 and 736 respectively.

To assemble a wall system such as the system 730 illustrated in FIG. 28, a drainage layer 744 should first be placed on the ground. The drainage layer 744 preferably includes drain rock that has been fully compacted, with a mechanical vibrating plate compactor, for example, and the layer of drain rock should preferably be level and have a depth of at least six inches and extend at least two feet behind the desired position of a front face of the wall. Next, the base apparatuses are placed on the drainage layer 744. A string line (not shown) may be used along the inside of the front stops of the base apparatuses to provide a reference for alignment and length wise levelling of the base apparatuses. Preferably, the base apparatuses are tilted slightly so that the back is approximately about ¼ inch lower than the front, to impart a slight back slope to the wall ultimately formed. If curvature of the wall system 730 is required, lateral projections, such as the lateral projections 634 and 636 in FIGS. 24 and 708 and 710 in FIG. 27, may be broken off. Furthermore, it is preferable to use further drain material, such as drain rock, to fill any gaps between the base apparatuses.

Next, a retaining wall adhesive (not shown) such as glue is applied to the top surfaces of the base apparatuses, and between vertically adjacent base apparatuses, to enhance stability and cohesiveness of the wall system. The construction apparatuses are preferably glued as far forward as possible, towards the front stops of the base apparatuses, while ensuring that the backs of the construction apparatuses line up evenly. When applying glue between vertically adjacent construction apparatuses, glue should preferably not be applied within the front ½ inch of the top surface of the construction apparatus, to avoid glue from being urged out of the front of the construction apparatuses. It has been found that wall systems having a height of over about three feet (1 m) may require engineering considerations such as using a stabilizer as described above, for example. Preferably, a stabilizer such as geogrid is installed every two rows where the construction apparatuses are approximately 8 inches in height. Furthermore, it has been found that for each foot of wall height, the bottom row of construction apparatuses should be buried at least one inch below a finished grade (not shown).

Figure 29:
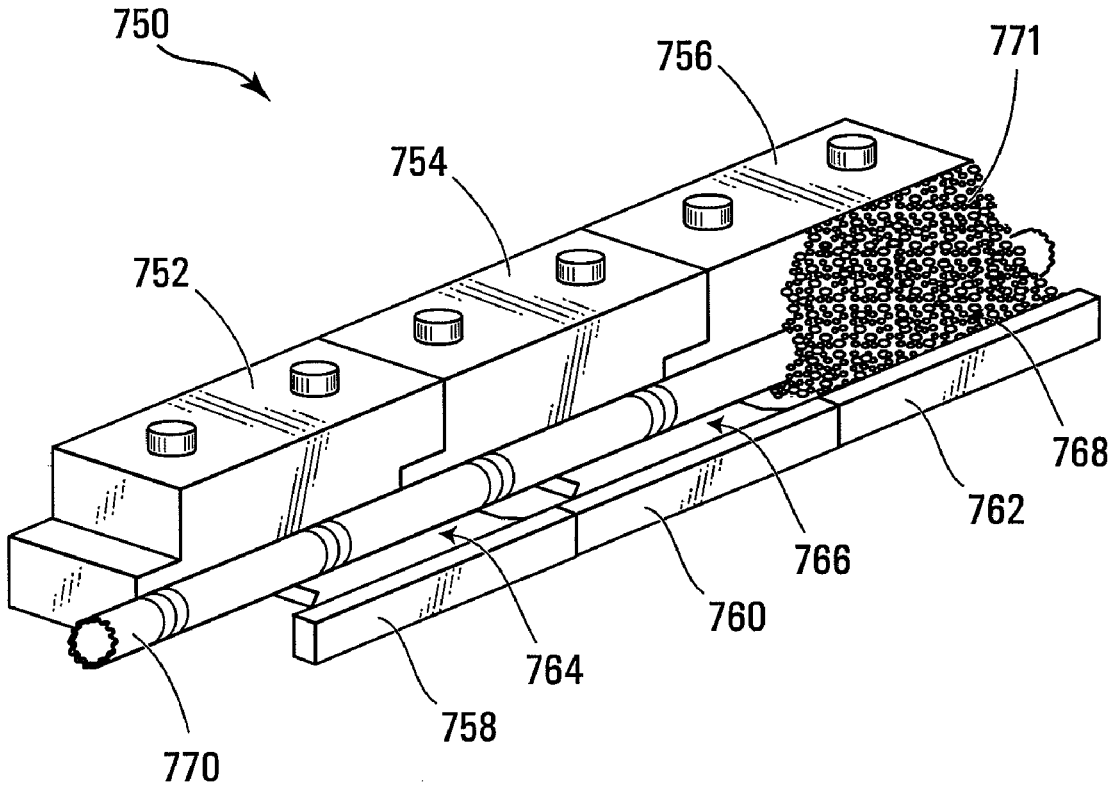
FIG. 29 is a rear perspective view of a wall system according to another embodiment of the invention.

Referring to FIG. 29, a wall system according to a further embodiment of the invention is shown generally at 750. The wall system 750 includes three construction apparatuses 752, 754, and 756 supported on the front support regions of base apparatuses 758, 760, and 762. The base apparatuses 758, 760, and 762 have respective rear retaining regions 764, 766, and 768. A conduit 770 such as a four-inch drain pipe, for example, is supported on the rear retaining regions 764, 766, and 768 for draining water away from the wall system 750. Water pervious landscaping cloth or other filtering material (not shown) may be placed around the conduit 770. Fill material 771 is placed on the rear retaining regions 764, 766, and 768, such that the fill material exerts a force on the rear retaining regions to resist rotation of the base apparatuses 758, 760, and 762 about respective horizontal axes of the base apparatuses. Preferably, drain rock under the base apparatuses 758, 760, and 762 extends at least two feet behind the wall. It will be appreciated that the wall system illustrated in FIG. 28 may further include stabilizers such as geogrid, as discussed above.

Generally, the use of the base apparatuses described herein provides a smooth, level surface on which construction apparatuses according to any of the various embodiments described herein may be placed. The base apparatuses described may also be used with other retaining wall systems such as those manufactured by Allan Block™, for example. The layer of drain rock under the base apparatuses 758, 760, and 762 and the use of the conduit 770 on the retaining regions 764, 766, and 768 of the base apparatuses facilitates drainage of water away from the wall. With base apparatuses placed on the drain rock, a consistent surface is provided to receive decorative construction apparatuses of any of the types described herein.

When a layer or first row of decorative construction apparatuses of the type shown at 30 in FIG. 2 are placed on the base apparatuses such that sides of adjacent construction apparatuses are engaged, the first row appears to be continuous with no readily discernible joints between adjacent construction apparatuses. This is due to the stepped side portions and selection of step rises according to a course width of readily discernible courses of block images in each construction apparatus. Using decorative construction apparatuses of the type shown at 30 in FIG. 2 that have steps that have lengths that are a multiple of the course width further obscures joints between adjacent construction apparatuses, making the joints between adjacent construction apparatuses even more difficult to discern.

If the intended height of a wall to be formed is more than about 4 ft., construction apparatuses of the engineered type shown at 290 in FIG. 10 or at 490 in FIG. 16, having recesses in their top surfaces for receiving stabilizers such as Geogrid, for example, should be used. A stabilizer such as Geogrid may be used on all rows or on selected rows, depending upon the quality of native soil upon which the wall is located. A soils or geotechnical engineer will normally specify a suitable amount and suitable placement of geogrid for the worksite conditions.

Where excavation behind the intended retaining wall is difficult or not practical, or where sheer mass is required, gravity construction apparatuses of the type shown at 510 in FIG. 17 may be used with or without the above mentioned site preparation and base apparatuses, to create the same continuous wall effect in which there are no readily discernible joints between adjacent construction apparatuses.

Any of the three basic types of construction apparatuses (decorative, engineered, gravity) can be used alone or in any combination, to produce the same continuous wall effect in which there are no readily discernible joints between adjacent construction apparatuses. In effect, the use of construction apparatuses of the types described herein provides for the creation of a retaining wall that has the appearance of a dry stacked stone wall, for example, without the need to place and bond individual stone pieces together. This eliminates the need for cutting stone into regularly sized stackable pieces and enables what appears to be a plurality of courses of stone to be placed as a group since one construction apparatus of the type described has a plurality of block images already formed in courses. Thus, a retaining wall having the appearance of a dry stacked stone wall can be produced in much less time than it would take to form the same wall from natural stone, and at significantly less cost.

While specific embodiments of the invention have been described and illustrated, such embodiments should be considered illustrative of the invention only and not as limiting the invention as construed in accordance with the accompanying claims.

I claim:

1. A construction apparatus comprising:

a body having a front, a rear, a top, a bottom, and first and second opposite sides, alignment projections projecting from said top operably configured to be received in corresponding recesses in a first vertically adjacent construction apparatus of the same type, and recesses in said bottom operably configured to receive corresponding projections projecting from a top of a second vertically adjacent construction apparatus of the same type, to permit vertical stacking of said construction apparatuses of said same type, wherein:

said front has a front surface having a plurality of block images configured to generally depict a plurality of courses of blocks, each of said courses having a respective course width;

said front surface generally lies in a first plane, said rear has a generally flat planar rear surface that lies in a second plane, and said first plane extends at a non-zero angle to said second plane; and wherein said projections and recesses are positioned on said top and bottom respectively to cooperate with corresponding recesses and projections on said first and second vertically adjacent construction apparatuses respectively to align said first and second vertically adjacent construction apparatuses such that a center of mass of said construction apparatus is set back from a center of mass of said second construction apparatus and such that a center of mass of said first vertically adjacent construction apparatus is set back relative to a center of mass of said construction apparatus while at the same time said front surface of said construction apparatus is coplanar with front surfaces of said first and second vertically adjacent construction apparatuses so that front faces of said first and second adjacent construction apparatuses will appear generally contiguous with said front face of said construction apparatus.

2. The construction apparatus of claim 1, wherein generally each of said block images in at least one of said courses has a length approximately equal to an integer multiple of at least one of said course widths.

3. The construction apparatus of claim 1, wherein said block images depict hewn rocks.

4. The construction apparatus of claim 3, wherein said block images are arranged to depict dry-stacked hewn rocks.

5. The construction apparatus of claim 1, wherein said body has a base colour, and wherein said block images are coloured differently from said base colour.

6. The construction apparatus of claim 1, wherein each said course has a common course width.

7. The construction apparatus of claim 1, wherein at least one of said plurality of courses includes a plurality of sub-courses.

8. The construction apparatus of claim 7, wherein each said course and sub-course comprises a plurality of said block images.

9. The construction apparatus of claim 1, wherein said top and bottom each have a respective thickness extending generally from said front to said rear, and wherein said thickness of said bottom is greater than said thickness of said top.

10. The construction apparatus of claim 1, wherein said alignment projections are parallel and spaced apart.

11. The construction apparatus of claim 10, wherein said bottom has first and second alignment recesses include first and second alignment recesses for receiving respective alignment projections of at least one generally vertically adjacent construction apparatus.

12. The construction apparatus of claim 11, wherein said first and second alignment projections have forward edges in a third plane parallel to a rear surface on said rear of said body, and wherein said first and second alignment recesses have forward edges in a fourth plane parallel to said rear surface, and wherein said third plane is spaced apart from said fourth plane towards said rear surface.

13. The construction apparatus of claim 10, wherein said first and second alignment projections are spaced apart longitudinally by a spacing distance selected such that when construction apparatuses of the same type are positioned laterally adjacent to said construction apparatus, such that complementary ends of said construction apparatuses are engaged with each other, a distance between laterally adjacent alignment projections on adjacent blocks is approximately equal to said spacing distance.

14. The construction apparatus of claim 1, wherein said top surface has a recess for holding a stabilizer operably configurable to impede toppling of said body when said body is resting on said bottom.

15. The construction apparatus of claim 1, wherein at least one of said first and second sides has a handle formed therein.

16. The construction apparatus of claim 15, wherein said handle includes a recess.

17. The construction apparatus of claim 1, wherein said rear has at least one recess to reduce a mass of said body.

18. The construction apparatus of claim 1, wherein said rear has a generally flat planar rear surface, and wherein said first and second sides each have at least two generally planar rear side surfaces extending at an obtuse angle to said generally flat planar rear surface.

19. The construction apparatus of claim 18, wherein said front surface has a first side portion and a second side portion disposed adjacent said first and second opposite sides of said body respectively, and wherein said first side has at least two generally flat planar front side surfaces extending generally perpendicularly to said first front side portion, and wherein said second side has at least two generally flat planar front side surfaces extending generally perpendicularly to said second front side portion.

20. The construction apparatus of claim 19, further comprising transition surfaces extending between respective adjacent front and rear side surfaces on each of said first and second sides.

21. The construction apparatus of claim 1, wherein said front surface is generally convex.

22. The construction apparatus of claim 1, wherein said front surface is generally concave.

23. The construction apparatus of claim 1, wherein said plurality of courses consists of six courses each having a common course width, and wherein said first and second sides have generally complementary steps defining six rises and five runs.

24. The construction apparatus of claim 23, wherein on each of said first and second sides, said five runs are approximately said common course width or approximately double said common course width.

25. The construction apparatus of claim 23, wherein said top has a thickness generally from said front to said rear that is from about 1.5 times said common course width to about 6 times said common course width.

26. The construction apparatus of claim 23, wherein said top has a thickness generally from said front to said rear that is from about 1.5 times said common course width to about 2.0 times said common course width.

27. The construction apparatus of claim 23, wherein said top has a thickness generally from said front to said rear that is from about 3.0 times said common course width to about 6 times said common course width.

28. The construction apparatus of claim 1, wherein said first and second sides have generally complementary step shapes comprising at least two rises and at least one run between said rises, each said rise being about equal to one of said course widths or a sum of a plurality of said course widths.

29. The construction apparatus of claim 28, wherein said run is equal to one of said course widths or to a sum of a plurality of said course widths.

30. A system comprising at least two construction apparatuses selected from the group comprising:

a) a first decorative construction apparatus comprising:

a first body having a first front, a first rear, a first top, a first bottom, first and second opposite sides, a first set of alignment projections projecting from said first top operably configured to be received in corresponding alignment recesses in an upper vertically adjacent construction apparatus of the same type, and a first set of alignment recesses in said first bottom operably configured to receive corresponding alignment projections projecting from a top of a lower vertically adjacent construction apparatus, wherein:

said first front has a first surface having a first plurality of block images configured to generally depict a first plurality of courses of blocks, each course in said first plurality of courses having a respective course width; and said first and second sides have generally complementary step shapes; and said first front surface generally lies in a first plane, said first rear has a first generally flat planar rear surface that lies in a second plane, and said first plane extends at a non-zero angle to said second plane;

b) a second decorative construction apparatus comprising:

a second body having a second front, a second rear, a second top, a second bottom, and third and fourth opposite sides, a second set of alignment projections projecting from said second top operably configured to be received in corresponding alignment recesses in another vertically adjacent construction apparatus of the same type, and a second set of alignment recesses in said second bottom operably configured to receive corresponding from a top of another lower vertically adjacent construction apparatus of the same type, wherein:

said second front has a second surface having a second plurality of block images configured to generally depict a second plurality of courses of blocks, each course in said second plurality of courses having a respective course width;

said third and fourth sides have generally complementary step shapes;

said second front surface generally lies in a third plane, said second rear has a second generally flat planar rear surface that lies in a fourth plane, and said third plane extends at a non-zero angle to said fourth plane; and said second top surface has a recess for receiving a stabilizer to prevent toppling of said second construction apparatus; and c) a third decorative construction apparatus comprising:

a third body having a third front, a third rear, a third top, a third bottom, and fifth and sixth opposite sides, a third set of alignment projections projecting from said third top operably et another upper vertically adjacent construction apparatus of the same type, and a third set of alignment recesses in said third bottom operably configured to receive corresponding alignment projections projecting from a top of yet another lower vertically adjacent construction apparatus of the same type, wherein:

said third front has a third surface having a third plurality of block images configured to generally depict a third plurality of courses of blocks, each course in said third plurality of courses having a common course width;

said fifth and sixth sides have generally complementary step shapes;

said third front surface generally lies in a fifth plane, said third rear has a third generally flat planar rear surface that lies in a sixth plane, and said fifth plane extends at a non-zero angle to said sixth plane; and said third top has a thickness generally from said third front to said third rear of from about 3.0 times said common course width to about 6 times said common course width;

wherein said at least two construction apparatuses are disposed adjacent each other such that adjacent sides of said at least two construction apparatuses are complementarily engaged to form a wall; and wherein said projections and recesses are positioned on said first, second and third tops and said first, second and third bottoms respectively to cooperate with corresponding recesses and projections on respective vertically adjacent construction apparatuses respectively to align said respective vertically adjacent construction apparatuses such that said front surfaces of said at least two construction apparatuses are coplanar with front surfaces of said respective vertically adjacent construction apparatuses so that front faces of said at least two construction apparatuses and said respective vertically adjacent construction apparatuses will appear coplanar and generally contiguous with said front faces of said at least two construction apparatuses.

31. A process for making the construction apparatus of claim 1, the process comprising:

placing at least one spacer in a form operably configured to define said body;

arranging a plurality of block image templates in a plurality of courses having respective course widths, in said form and on said at least one spacer such that said front surface of said body generally lies in said first plane extending at said non-zero angle to said second plane ;

placing a moldable material into said form and on said block image templates; and causing said moldable material to solidify in said form to define said body such that said front surface of said body has said plurality of block images defined by said block 32. The process of claim 31 wherein placing a moldable material comprises placing an uncured concrete mix into said form and on said block image templates.

33. The process of claim 32 further comprising placing a colored slurry on at least one of said block image templates prior to placing said concrete mix into said form, such that said colored slurry infuses into said uncured concrete mix to color said uncured concrete in contact with said at least one of said block image templates.

34. The process of claim 31 wherein placing said at least one spacer comprises placing a tapered spacer.

35. The process of claim 31 wherein placing said at least one spacer comprises placing said at least one spacer adjacent a top forming portion of said form such that said body formed by said form has a top thickness that is less than a bottom thickness of said body.

36. The process of claim 31 wherein placing said at least one spacer comprises placing at least one spacer under at least some of said courses of said block image templates, such that each course is spaced from a bottom of said form a different distance so that said body will have a greater thickness near said bottom than near said top.

37. The process of claim 36 wherein placing at least one spacer under at least some of said courses comprises placing a plurality of spacers such that each course is associated with a respective spacer size.

38. A wall system comprising:

a) a base apparatus; and b) the construction apparatus of claim 1 on said base apparatus, said base apparatus comprising:

a plate having a first top, a first bottom, a first front, a first rear, and first and second opposite sides, wherein said first top includes a generally planar surface having a front support region proximate said first front for supporting said construction apparatus and a rear retaining region proximate said first rear for supporting material adjacent a rear of said construction apparatus;

at least one front stop projecting upwardly from said generally planar surface of said first top, adjacent said first front, for stopping said construction apparatus from sliding forward on said first top; and at least one rear retainer projecting upwardly from said generally planar surface of said first top, adjacent said first rear, for retaining material closely adjacent said construction apparatus when said construction apparatus is installed on said support region, wherein said first and second sides are wider adjacent said first front than adjacent said first rear.

39. The system of claim 38 further comprising fill material on said rear retaining region, such that said fill material exerts a force on said rear retaining region to resist rotation of said base apparatus about a horizontal axis.

40. The system of claim 38 further comprising a conduit on said rear retaining region for draining water away from said wall system.

41. The system of claim 40 further comprising fill material on said conduit, such that said fill material exerts a force on said conduit and said rear retaining region to resist rotation of said base apparatus about a horizontal axis.

42. The system of claim 38, wherein said rear retainer comprises first and second lateral projections extending laterally adjacent said first and second sides respectively.

43. The system of claim 42, wherein said rear retainer comprises a main portion extending between said first and second lateral projections.

44. The system of claim 42, wherein said rear retainer comprises first and second frangible portions connecting said first and second lateral portions respectively to said main portion.

45. The system of claim 38, wherein said at least one stop includes first and second spaced apart stops adjacent said first and second opposite sides respectively.

* * * * *